US012668330B2

(12) United States Patent
Lindblade et al.

(10) Patent No.: US 12,668,330 B2
(45) Date of Patent: Jun. 30, 2026

(54) MOORING SYSTEMS AND PROCESSES FOR USING SAME

(71) Applicant: SOFEC, INC., Houston, TX (US)

(72) Inventors: Stephen P. Lindblade, Waller, TX (US); Hao Yu, Katy, TX (US); Miles A. Hobdy, Richmond, TX (US)

(73) Assignee: MODEC AMERICA, INC., Houston, TX (US)

( * ) Notice: Subject to any disclaimer, the term of this patent is extended or adjusted under 35 U.S.C. 154(b) by 736 days.

(21) Appl. No.: 18/172,088

(22) Filed: Feb. 21, 2023

(65) Prior Publication Data

US 2023/0264790 A1 Aug. 24, 2023

Related U.S. Application Data

(60) Provisional application No. 63/312,556, filed on Feb. 22, 2022.

(51) Int. Cl.

| | |
|---|---|
| ***B63B 21/50*** | (2006.01) |
| ***B63B 21/04*** | (2006.01) |
| ***B63B 21/16*** | (2006.01) |
| ***B63B 21/20*** | (2006.01) |

(52) U.S. Cl.

CPC ..... *B63B 21/507* (2013.01); *B63B 21/04* (2013.01); *B63B 21/16* (2013.01); *B63B 21/20* (2013.01)

(58) Field of Classification Search

CPC ..... B63B 21/507; B63B 21/04; B63B 21/16; B63B 21/20; B63B 2021/002; B63B 22/023; B63B 22/026

See application file for complete search history.

(56) References Cited

U.S. PATENT DOCUMENTS

| | | | | |
|---|---|---|---|---|
| 4,490,121 | A * | 12/1984 | Coppens | B63B 21/50 114/230.15 |
| RE32,578 | E * | 1/1988 | Poldervaart | B63B 22/026 441/5 |
| 6,162,105 | A | 12/2000 | Breivik | |
| 2020/0324862 | A1 | 10/2020 | Ganzinga et al. | |

FOREIGN PATENT DOCUMENTS

| | | |
|---|---|---|
| WO | 1992012045 A1 | 7/1992 |
| WO | 1996014237 A1 | 5/1996 |

OTHER PUBLICATIONS

International Search Report and Written Opinion for PCT/US2023/062940 dated Jun. 6, 2023.

* cited by examiner

*Primary Examiner* — Anthony D Wiest
(74) *Attorney, Agent, or Firm* — Edmonds & Cmaldaika, P.C.

(57) ABSTRACT

A mooring system for mooring a vessel floating on a surface of a body of water. The system can include a base structure, a mooring leg, a column, and a turntable. The mooring leg can include a first end configured to be attached to a seabed and a second end configured to be attached to the base structure. The column can include a first end attached to the base structure. The turntable can include a rotating part and a fixed part. A second end of the column can be configured to be connected to the fixed part of the turntable via a dual axis joint. The rotating part of the turntable can be configured to be connected to the vessel. The base structure can be configured to be elevated above of the seabed when the second end of the column is connected to the fixed part of the turntable.

20 Claims, 13 Drawing Sheets

MOORING SYSTEMS AND PROCESSES FOR USING SAME

CROSS-REFERENCE TO RELATED APPLICATION

This application claims priority to U.S. Provisional Patent Application No. 63/312,556, filed on Feb. 22, 2022, which is incorporated by reference herein.

FIELD

Embodiments described generally relate to mooring systems and processes for using same. More particularly, such embodiments relate to mooring systems for mooring a vessel floating on a surface of a body of water and processes for using same.

BACKGROUND

In the offshore oil and gas industry, mooring systems have been used for many years to moor a vessel on a surface of a body of water. In relatively shallow waters, for example less than 50 meters of water, traditional chain mooring systems have been ineffective and yoke mooring systems, while effective, include complex mechanical systems located beneath the surface of the water. Locating these mechanical systems below the surface of the water is difficult and expensive from a design, manufacturing, operating, and maintenance perspective.

Recent developments have made yoke mooring systems more feasible, but only when the yoke is disposed above the surface of a body of water. These above water yoke mooring systems can be costly given that there is significant expense required to locate the yoke above the surface of the body of the water.

There is a need, therefore, for improved mooring systems and processes for using same.

SUMMARY

Mooring systems and processes for using same are provided. In some embodiments, the system can include a base structure, a mooring leg, a column, and a turntable. The mooring leg can include a first end configured to be attached to a seabed and a second end configured to be attached to the base structure. The column can include a first end attached to the base structure. The turntable can include a rotating part rotatively connected to a fixed part. A second end of the column can be configured to be connected to the fixed part of the turntable via a dual axis joint. The rotating part of the turntable can be configured to be connected to the vessel such that the vessel is rotatable with respect to the column when the second end of the column is connected to the fixed part of the turntable. The base structure can be configured to be elevated above of the seabed when the second end of the column is connected to the fixed part of the turntable.

In some embodiments, a process for mooring a vessel floating on a surface of a body of water to a mooring system can include positioning the vessel near the mooring system. The mooring system can include a base structure, a mooring leg, a column, a turntable, a releasable connector, a lifting device, and a lifting line. The base structure can be sitting on a seabed. The mooring leg can include a first end attached to the seabed and a second end attached to the base structure. The column can have a first end attached to the base structure and a second end attached to a dual axis joint. The turntable can have a rotating part rotatively coupled to a fixed part. The rotating part of the turntable can be connected to the vessel. The releasable connector can include a first component connected to the dual axis joint and a second component connected the fixed part of the turntable. The lifting device can be disposed on the vessel. The lifting line can have a first end connected to the first component of the releasable connector and a second end configured to be connected to the lifting device. The process can include connecting the second end of the lifting line to the lifting device. The process can also include hauling in the lifting line with the lifting device to lift the column, the base structure, and at least a portion of the mooring leg to move the first component of the releasable connector into an engagement position with respect to the second component of the releasable connector. The process can also include connecting the first component of the releasable connector to the second component of the releasable connector to secure the vessel to the mooring system. The base structure can be elevated above of the seabed and the vessel can be rotatable with respect to the column when the first and second components of the releasable connector are connected to one another.

In some embodiments, a process for unmooring a vessel floating on a surface of a body of water from a mooring system can include releasing a releasable connector. The mooring system can include a base structure, a mooring leg, a column, a turntable, the releasable connector, a lifting device, and a lifting line. The base structure can be elevated above of a seabed. The mooring leg can have a first end attached to the seabed and a second end attached to the base structure. The column can have a first end attached to the base structure and a second end attached to a dual axis joint. The turntable can include a rotating part rotatively coupled to a fixed part. The rotating part of the turntable can be connected to the vessel. The releasable connector can include a first component connected to the dual axis joint and a second component connected the fixed part of the turntable such that the vessel is rotatable with respect to the column. The lifting device can be disposed on the vessel. The lifting line can have a first end connected to the first component of the releasable connector and a second end connected to the lifting device. The process can also include lowering the column, the base structure, and a portion of the mooring leg toward the seabed with the lifting line and the lifting device such that the base structure sits on the seabed. The process can also include disconnecting the second end of the lifting line from the lifting device. The process can also include maneuvering the vessel away from the mooring system.

DETAILED DESCRIPTION

Figure 1:
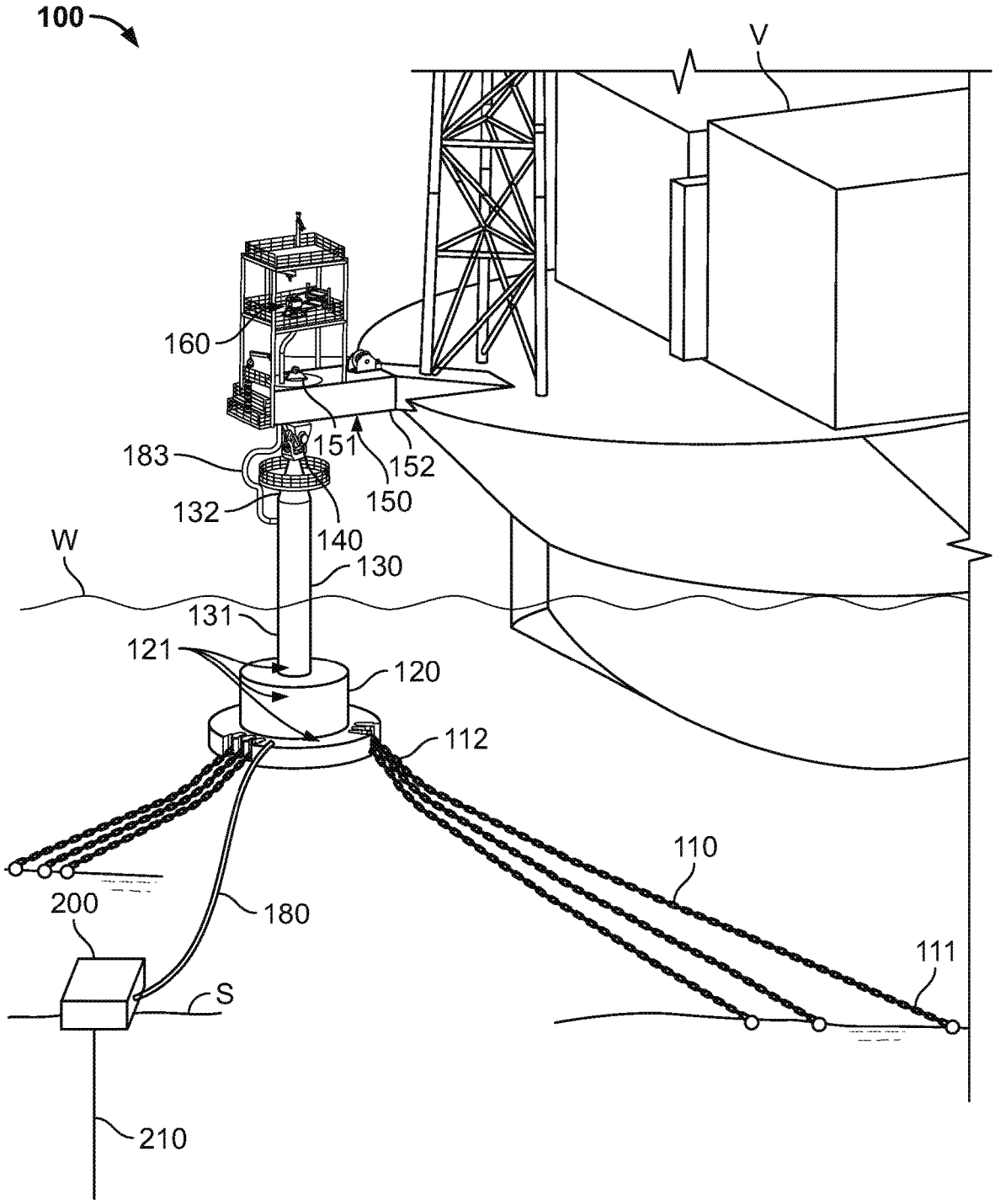
FIGS. 1 and 2 depict an isometric view and a partial cross-section elevation view, respectively, of an illustrative mooring system for mooring a vessel floating on a surface of a body of water, according to one or more embodiments described.

A detailed description will now be provided. Each of the appended claims defines a separate invention, which for infringement purposes is recognized as including equivalents to the various elements or limitations specified in the claims. Depending on the context, all references to the "invention", in some cases, refer to certain specific or preferred embodiments only. In other cases, references to the "invention" refer to subject matter recited in one or more, but not necessarily all, of the claims. It is to be understood that the following disclosure describes several exemplary embodiments for implementing different features, structures, or functions of the invention. Exemplary embodiments of components, arrangements, and configurations are described below to simplify the present disclosure; however, these exemplary embodiments are provided merely as examples and are not intended to limit the scope of the invention. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the Figures. Moreover, the formation of a first feature over or on a second feature in the description that follows includes embodiments in which the first and second features are formed in direct contact and also includes embodiments in which additional features are formed interposing the first and second features, such that the first and second features are not in direct contact. The exemplary embodiments presented below may be combined in any combination of ways, i.e., any element from one exemplary embodiment may be used in any other exemplary embodiment, without departing from the scope of the disclosure. The figures are not necessarily drawn to scale and certain features and certain views of the figures can be shown exaggerated in scale or in schematic for clarity and/or conciseness.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Also, the naming convention used herein is not intended to distinguish between components that differ in name but not function. Furthermore, in the following discussion and in the claims, the terms "including" and "comprising" are used in an open-ended fashion, and thus should be interpreted to mean "including, but not limited to."

Further, the term "or" is intended to encompass both exclusive and inclusive cases, i.e., "A or B" is intended to be synonymous with "at least one of A and B," unless otherwise expressly specified herein. The indefinite articles "a" and "an" refer to both singular forms (i.e., "one") and plural referents (i.e., one or more) unless the context clearly dictates otherwise. The terms "up" and "down"; "upward" and "downward"; "upper" and "lower"; "upwardly" and "downwardly"; "above" and "below"; and other like terms used herein refer to relative positions to one another and are not intended to denote a particular spatial orientation since the apparatus and processes of using the same may be equally effective at various angles or orientations.

The terms "orthogonal" and "orthogonally", as used herein, refer to two lines or vectors that are not coplanar, i.e., skew lines, and, therefore, do not intersect but can appear to be perpendicular when viewed from a particular angle. Said another way, two skew lines or vectors can be said to be "orthogonal" if they form a 90 degree projected angle. For example, in a three dimensional cartesian coordinate system, a line parallel to the X-axis with a constant Z-value of 1 is orthogonal to a line parallel to the Y-axis with a constant Z-value of 2 because these lines will not intersect and the lines are orientated at 90 degrees with respect to one another when viewed along the Z-axis. As yet another example of a first line being orthogonal to a second line, the first line can lie in a first plane and the second line can lie in a second plane, where the first and second planes are parallel with respect to one another and the first line and the second line are oriented at 90 degrees with respect to one another when viewed along an axis that is normal to the first and second planes. Further, the term "substantially" when used in the context of "substantially orthogonal" means the first and second lines are orientated at angles of about 80 degrees, about 83 degrees, about 85 degrees, about 87 degrees, or about 89 degrees to, about 91 degrees, about 93 degrees, about 95 degrees, about 97 degrees, or about 100 degrees with respect to one another when viewed along an axis that is normal to the first and second planes.

The terms "perpendicular" and "perpendicularly", as used herein, refer to two lines or vectors that are coplanar and, therefore, do intersect one another at a 90 degree angle. Further, the term "substantially" when used in the context of "substantially perpendicular" means a first line and a second line are orientated at angles of about 80 degrees, about 83 degrees, about 85 degrees, about 87 degrees, or about 89 degrees to, about 91 degrees, about 93 degrees, about 95 degrees, about 97 degrees, or about 100 degrees with respect to one another. Further, the term "substantially" when used in the context of "substantially parallel" means an axis and a plane (e.g., the surface of a body of water) are orientated at angles of about 160 degrees, about 165 degrees, about 170 degrees, about 175 degrees, or about 180, or about 185 degrees, or about 190 degrees, or about 195 degrees, or about 200 degrees with respect to one another.

The term "vessel" refers to any type of floating structure including, but not limited, to tankers, boats, ships, barges, F SOs, FPSOs, FLNGs, FSRUs, and the like.

Figure 2:
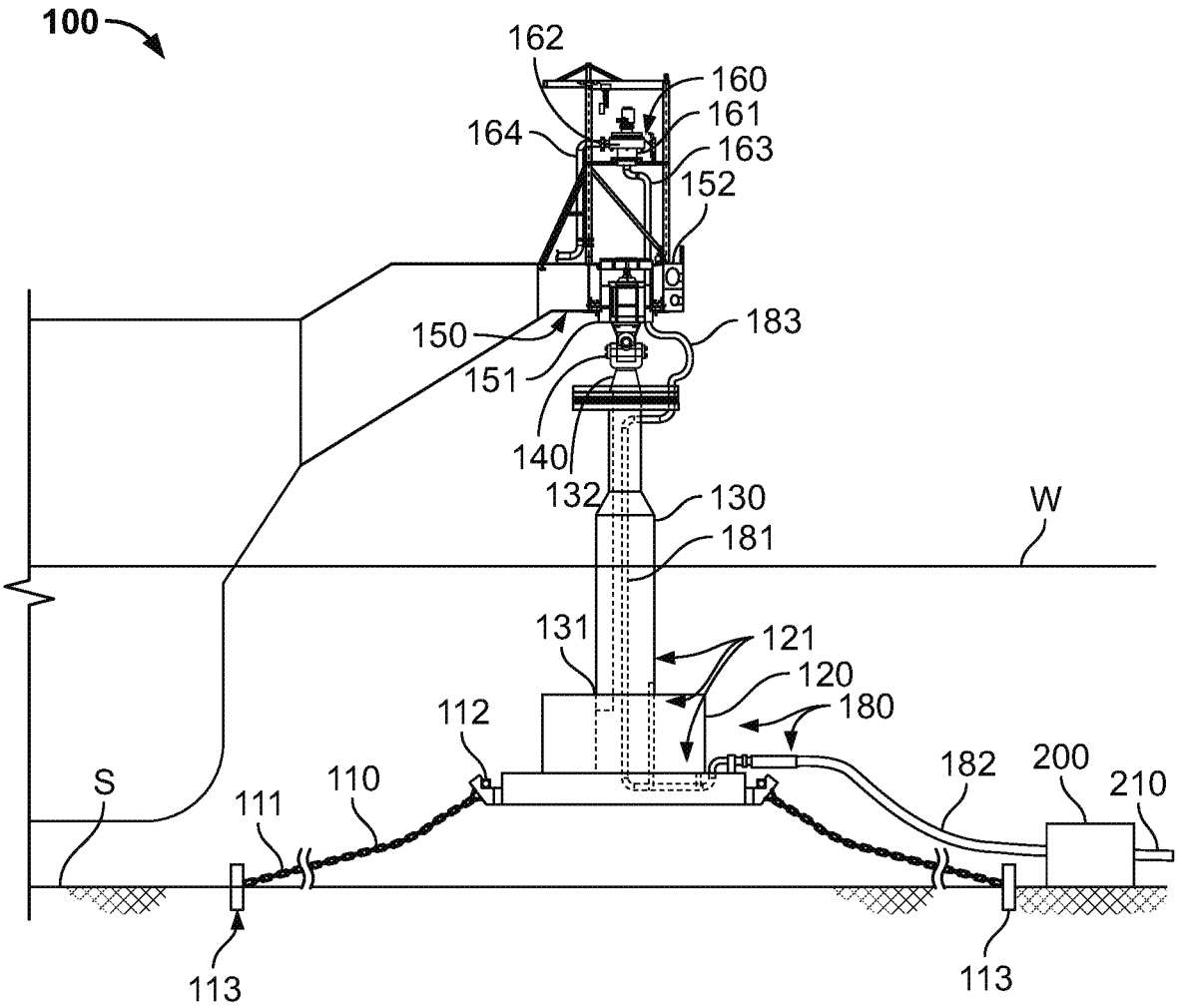

FIGS. 1 and 2 depict an isometric view and a partial cross-section elevation view, respectively, of an illustrative mooring system 100 for mooring a vessel V floating on a surface of a body of water W, according to one or more embodiments. In some embodiments, the mooring system 100 can include at least one mooring leg 110 (six are visible in FIG. 1), a base structure 120, a column 130, a multi-axis joint 140, e.g., a dual axis joint, a turntable 150, a swivel 160, and an optional conduit 180 (a portion of which is shown in FIG. 1, the remaining portions can be disposed within the base structure 120 and/or column 130 and/or on an exterior of the base structure 120 and/or column 130).

In some embodiments, the mooring system 100 can include 1, 2, 3, 4, 5, 6, 7, 8, 9, 10, 11, 12, or more mooring legs 110. The mooring leg(s) 110 can include a first end 111 and a second end 112. The first end 111 of the mooring leg 110 can be configured to be attached or otherwise connected to the seabed S and the second end 112 of the mooring leg 110 can be configured to be attached or otherwise connected to the base structure 120. In some embodiments, the first end 111 of the mooring leg 110 can be attached to the seabed S with a drag embedment anchor, a suction pile, gravity anchor, a driven pile, or any combination thereof (driven piles 113 are shown in FIG. 2).

The column 130 can include a first end 131 and a second end 132. In some embodiments, the first end 131 of the column 130 can be attached, e.g., fixedly attached or rotatively attached, to the base structure 120. In other embodiments, the first end 131 of the column 130 can be attached to the base structure 120 via a multi-axis joint, e.g., a dual axis joint, that can be substantially similar or the same as the multi-axis joint 140 described in more detail below.

The turntable 150 can include a fixed part 151 and a rotating part 152. The rotating part 152 of the turntable 150 can be configured to be connected to the vessel V. The second end 132 of the column 130 can be configured to be connected to the fixed part 151 of the turntable 150 via the multi-axis joint 140. For example, in some embodiments, the multi-axis joint 140 can be directly connected to the fixed part of the turntable 150. In another example, in some embodiments, the multi-axis joint 140 can be connected to the fixed part of the turntable 150 via a releasable connector as further described below with reference to FIG. 4. When the second end 132 of the column 130 is connected to the fixed part 151 of the turntable 150, the vessel V can be rotatable with respect to the column 130. As shown in FIGS. 1 and 2, when the vessel V is moored to the mooring system 100, i.e., the second end 132 of the column 130 is connected to the fixed part 151 of the turret 150, the base structure 120 can be elevated above the seabed S.

The swivel 160 can include a first part 161 rotatively coupled to a second part 162 (see FIG. 2) and can be configured to maintain communication between the first part 161 of the swivel 160 and the second part 162 of the swivel 160 when the second part 162 of the swivel 160 rotates relative to the first part 161 of the swivel 160. In some embodiments the first part 161 of the swivel 160 can be connected to the fixed part 151 of the turntable 150 and the second part 162 of the swivel 160 can be connected to the rotating part 152 of the turntable 150 or the vessel V. The swivel 160 can be configured to maintain communication between a conduit 163 disposed on the fixed part 151 of the turntable 150 and a conduit 164 disposed on the rotating part 152 of the turntable 150 while the vessel V rotates about the column 130. The swivel 160 can provide 1, 2, 3, 4, 5, 6, or more independent paths therethrough. In some embodiments the swivel 160 can be configured as a fluid swivel. In other embodiments the swivel 160 can be configured as an electrical swivel or electrical slip ring, or as a fiber optic swivel. In other embodiments, the swivel 160 can be configured as a combined fluid and/or electrical swivel or electrical slip ring and/or fiber optic swivel. The fixed part 161 and the rotating part 162 of the swivel 160 can be configured to maintain fluid communication, electrical communication, and/or optical communication therebetween, depending on the particular configuration of the swivel 160. As such, the conduits 163 and 164 can be fluid conduits, electrical conduits, and/or optical fiber conduits.

In some embodiments, at least one fluid conduit 180 can be attached to or otherwise disposed on the mooring system 100. The fluid conduit 180 can be configured to convey a fluid from a corresponding pipeline 210 and/or pipeline end manifold 200 disposed on the seabed S to the fluid conduit 163 disposed on the fixed part 151 of the turntable 150. In other embodiments, the fluid conduit 180 can be configured to convey a fluid from the fluid conduit 163 disposed on the fixed part 151 of the turntable 150 to the pipeline 210 or the pipeline end manifold 200 disposed on the seabed S. Examples of conveyable fluids can be or can include, but are not limited to, natural gas, oil, ammonia, water, diesel, gasoline, liquid petroleum gas, liquified natural gas, crude oil, hydraulic fluid, carbon dioxide, air, or any other fluid. As shown in FIG. 2, in some embodiments, the fluid conduit(s) 180 can include one or more rigid pipe segments 181 mounted on, affixed to, disposed within, or otherwise supported in, on, or by the base structure 120 and/or the column 130 and one or more flexible pipe segments (two are shown, 182 and 183) that can bridge between the base structure 120 and/or the column 130 and the pipeline 210 or the pipeline end manifold 200 and/or between the column 130 and the fixed part 151 of the turntable 150, respectively, such that the fluid can be conveyed to the fluid conduit 163 disposed on the fixed part 151 of the turntable 150 from the pipeline end manifold 200 or the pipeline 210 or from the fluid conduit 163 to the pipeline 210 or the pipeline end manifold 200, while the column 130 pivots relative to the fixed part 151 of the turntable 150 and/or while the base structure 120 moves relative to the seabed S.

In some embodiments, the mooring system 100 can include a weight 121. The weight 121 can provide a restoring force acting on the vessel V as the vessel V moves from a center point of the mooring system 100 in response to loads acting on the vessel V. In some embodiments, the weight 121 can be a solid body that can have a fixed mass. In other embodiments, the weight 121 can be configured as a ballast tank that can contain a ballast material. In such embodiment, the ballast tank can be disposed within an interior space of the column 130 and/or within an interior space of the base structure 120 and/or as a component that can be separate and apart from the column 130 and the base structure 120. The ballast material can be any suitable solid material or liquid material or combination thereof. Examples of ballast material can be or can include, but are not limited to, concrete, sand, aggregate, iron ore, magnetite, rocks, drilling mud, water, sea water, any other material or combination thereof. The ballast material can provide a weight to the mooring system 100 to provide a restoring force acting on the vessel V as the vessel V moves from a center point of the mooring system in response to loads acting on the vessel V.

Figure 3:
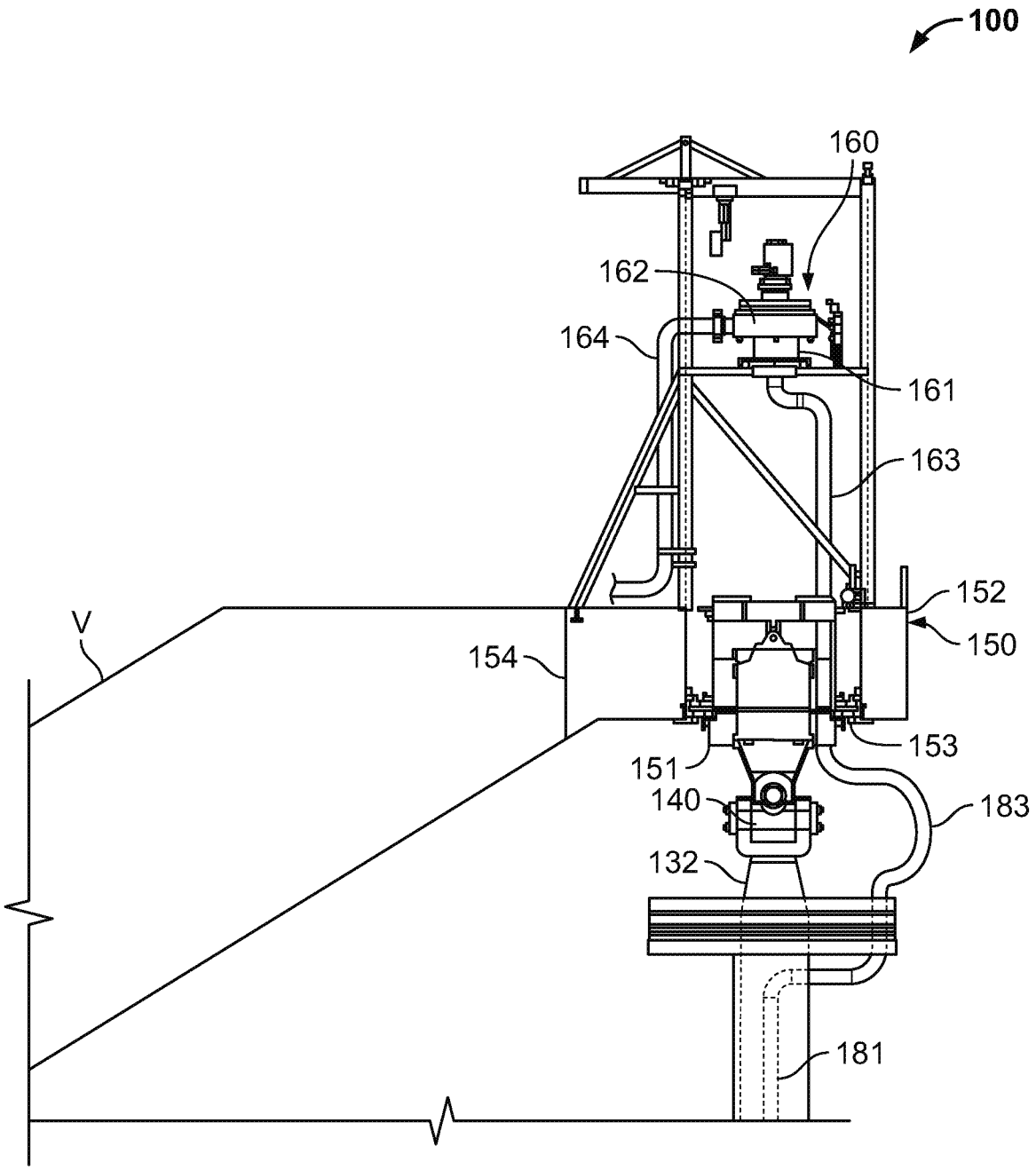
FIG. 3 depicts a close-up partial cross-section elevation view of a portion of the illustrative mooring system shown in FIGS. 1 and 2 that more clearly shows a turntable, a swivel, and a dual axis joint, according to one or more embodiments described.

FIG. 3 depicts a close-up partial cross-section view of a portion of the illustrative mooring system 100 shown in FIG. 2 that more clearly shows the turntable 150, the swivel 160, and the multi-axis joint 140 as being a dual axis joint, according to one or more embodiments. In some embodiments, the multi-axis joint 140 can provide for rotation about two axes of rotation that can be substantially orthogonal to one another. In other embodiments, the multi-axis joint 140 can provide for rotation about two axes of rotation that can be substantially perpendicular to one another. In this way, the column 130 can rotate or pivot relative to the fixed part 151 of the turntable 150 about two axes of rotation. In some embodiments, the multi-axis joint 140 can include the dual axis joint disclosed in U.S. Patent Application Nos. 63/279,420; 63/306,239; 63/439,949; and/or U.S. Ser. No. 18/055,167. In other embodiments, the multi-axis joint 140 can include a ball and socket joint, or other type of joint, not shown can be used to connect the column 130 to the turntable 150. In some embodiments, an illustrative ball and socket joint can include the ball and socket joint disclosed in U.S. Patent Application No. 63/358,738.

In some embodiments, the turntable 150 can provide for unlimited rotation of the vessel V relative to the fixed part 151 of the turntable 150. The turntable 150 can include an interface structure 154. The interface structure 154 can be a structure configured to matingly interface with the structural configuration of the vessel V. The interface structure 154 can be configured to transfer loads from the vessel V to the turntable 150 and/or from the turntable 150 to the vessel V. The turntable 150 can be configured to transfer loads from the fixed part 151 to the rotating part 152 of the turntable 150 and/or from the rotating part 152 to the fixed part 151 of the turntable 150 while the vessel V rotates about the fixed part of 151 of the turntable 150. In some embodiments the turntable 150 can be a fabricated structure, e.g., a steel structure. The turntable 150 can include a bearing 153 that can rotatably connect the fixed part 151 of the turntable 150 to the rotating part 152 of the turntable 150. In some embodiments, the bearing can be any suitable mechanical bearing, e.g., a 3-row roller bearing, a wheel and rail type bearing, a plane bearing system, or a bushing type bearing system.

Figure 4:
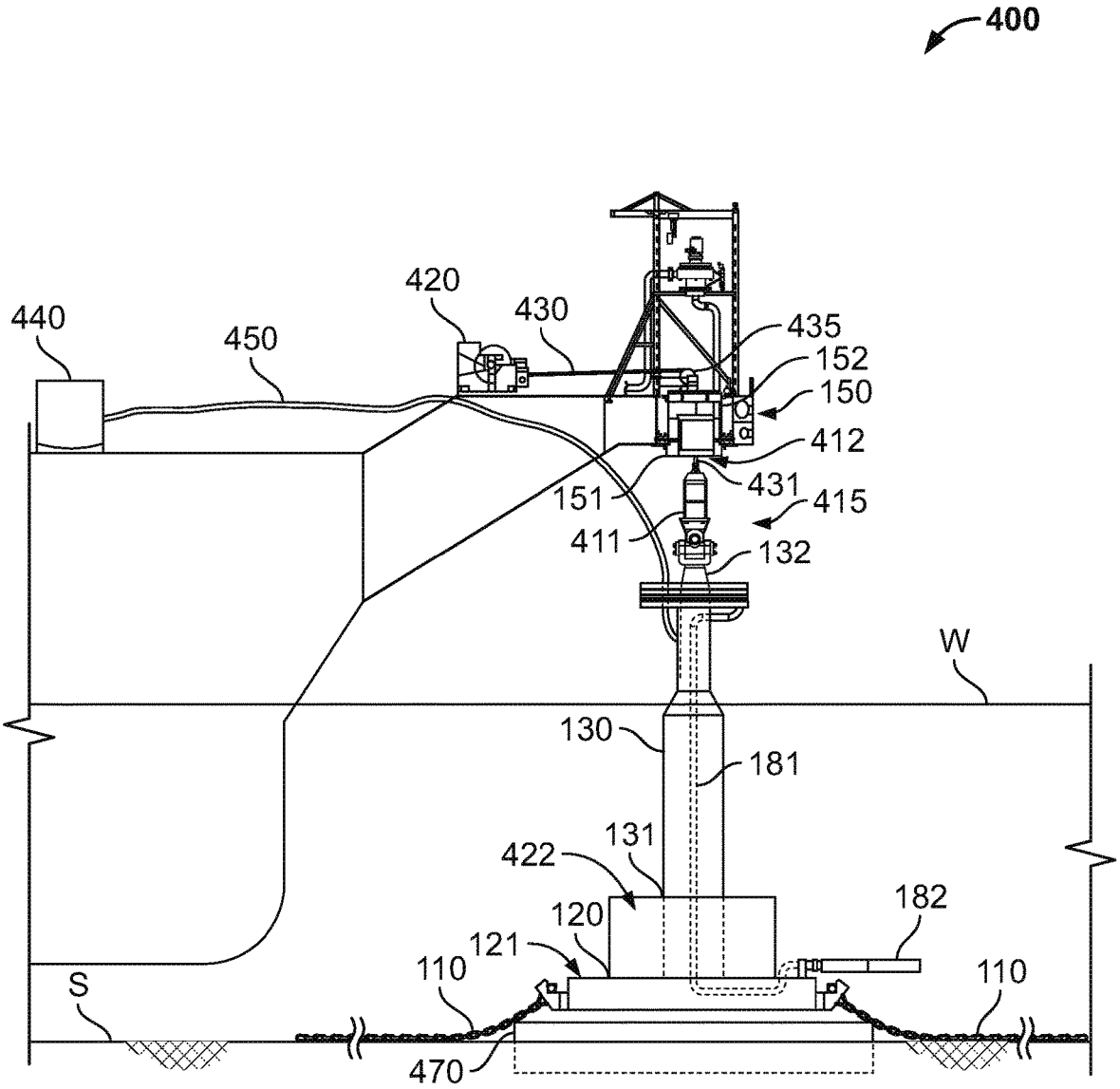
FIG. 4 depicts a partial cross-section elevation view of another illustrative mooring system that includes a releasable connector in a disconnected configuration, a lifting device, a lifting line, and an optional landing structure, according to one or more embodiments described.

FIG. 4 depicts a partial cross-section elevation view of an illustrative mooring system 400 that includes a releasable connector 415 in a disconnected configuration, a lifting device 420, a lifting line 430, and an optional landing structure 470, according to one or more embodiments. In some embodiments, the lifting device 420 can be disposed on the vessel V, e.g., near, or above or below the turntable 150. The lifting device 420 can be or can include, but is not limited to, a chain jack, a strand jack, a linear winch, a rotary winch, other similar device, or combinations thereof. The lifting device 420 can be electrically driven, hydraulically driven, pneumatically driven, hydrocarbon combustion driven, or a combination thereof. In some embodiments, the lifting device 420 can be disposed on the vessel V and the lifting line 430 can be routed through at least one sheave 435. The at least one sheave 435 can provide flexibility as to where the lifting device 420 can be disposed on the vessel V.

The releasable connector 415 can include a first component 411 connected to or otherwise disposed on the second end 132 of the column 130, e.g., the multi-axis joint 140, and a second component 412 connected to or otherwise disposed on the fixed part 151 of the turntable 150. In some embodiments, the first component 411 of the releasable connector 415 can be configured as a stinger and can be connected to the second end 132 of the column 130 via the multi-axis joint 140. The second component 412 of the releasable connector 415 can include a sleeve assembly connected to or mounted on the fixed part 151 of the turntable 150. In some embodiments, the releasable connector 415 can include a latching mechanism, not shown, that can be moved from an unlocked position to a locked position to secure the first component 411 of the releasable connector 415 at least partially within the second component 412 of the releasable connector 415. In some embodiments, the releasable connector 415 that can include the first component 411 and the second component 412 can include the releasable connectors disclosed in U.S. Patent Application No. 63/255,749; U.S. Ser. Nos. 17/962,087; 17/966,184; and U.S. Ser. No. 18/155,527.

The lifting line 430 can include a first end 431 configured to be connected to the first component 411 of the releasable connector 415, the second end 132 of the column 130 (not shown) or the multi-axis joint 140 (not shown). In some embodiments, the mooring system 400 can also include an optional retrieval line, not shown, that can be connected to the second end (not shown) of the lifting line 430. The retrieval line can be configured such that at least a portion of the retrieval line can float on the surface of the body of water W to facilitate retrieval of the lifting line 430. In some embodiments, a buoy can be disposed at a second end of the retrieval line to maintain the second end of the retrieval line on the surface of the body of water W. In such embodiment, the retrieval line can be retrieved from the surface of the body of water W and routed to the lifting device 420. The lifting device 420 be used to haul in the retrieval line until the second end of the lifting line 430 is adjacent or proximate to the lifting device 420. The lifting line 430 can then be engaged with the lifting device 420 and the lifting device 420 can be used to haul in the lifting line 430 to lift the column 130, at least a portion of the base structure 120, and at least a portion of the mooring leg 110 until the first part 411 of the releasable connector 415 can be connected to the second component 412 of the releasable connector 415 for connection of the vessel V to the mooring system 400. In other embodiments, the lifting device 420 can be used to haul in the lifting line 430 when the optional retrieval line is not used.

The lifting device 420 can be configured to lift the column 130, at least a portion of the base structure 120, and at least a portion of the mooring legs 110 from a position where the base structure 120 and at least a portion of the mooring legs 110 are resting on the seabed S or the optional landing structure 470, e.g., a mud mat, located on the seabed S to a position at which the column 130, at least a portion of the base structure 120, and at least a portion of the mooring legs 110 can be suspended from the vessel V. The lifting device 420 can also be configured to lower the column 130, the base structure 120, and at least a portion of the mooring legs 110 from a suspended position to a position where the base structure 120 and at least a portion of the mooring legs 110 rest or sit on the seabed S and/or rest or sit on the optional landing structure 470.

In some embodiments, the lifting device 420 can be configured such that a speed at which the lifting device 420 operates to haul in the lifting line 430 can be tuned, adjusted, or otherwise correlated to account for a motion of the vessel V that can be caused by vessel heave, wind, waves, swell, and/or current present at a given mooring location. Said another way, the lifting device 420 can be configured to lift and lower the column 130, the base structure 120 and at least a portion of the mooring legs 110 at a variable speed that is at least partially dependent on a motion of the vessel V. In some embodiments, the lifting device 420 can be configured such that a speed at which the lifting device 420 operates to haul in the lifting line 430 is not tuned, adjusted, or otherwise correlated to account for a motion of the vessel V. Said another way, the lifting device 420 can be configured to lift and lower the column 130, the base structure 120 and at least a portion of the mooring legs 110 at a speed that is independent from a motion of the vessel V, e.g., at a constant speed.

In some embodiments, the optional landing structure 470 that can be disposed on the seabed S beneath at least a portion of the base structure 120 such that when the mooring system 400 is disconnected, the base structure 120 can be at least partially set on the landing structure 470. The landing structure can be incorporated into any of the embodiments described herein. The landing structure can be configured as a steel frame, e.g., a steel fabricated structure, or a steel or concrete mattresses, gravel pile, rocks placed on the seabed, or other similar material. The landing structure 470 can provide a suitable surface for the base structure 120 to land on, be set down on, or laid down on such that the base structure 120 does not get stuck or adhere to the seabed S which is possible and even likely as some seabeds can often have a soft, muddy consistency.

In some embodiments, the base structure 120 can include a jetting system incorporated therewith, not shown. The jetting system can be configured to eject a gas, a liquid, or a mixture thereof into the seabed directly beneath a lower surface of the base structure to facilitate separation of the base structure 120 from the seabed S should the base structure 120 become stuck in the seabed S while disconnected from the vessel V. The jetting system can include one or more jets or nozzles that can be supplied a gas and/or liquid via one or more compressed gas cylinders, pumps, or the like.

In some embodiments, the mooring system 400 can be configured such that the base structure 120 and at least a portion of the column 130 can be submerged or disposed below the surface of the body of the water W when the first part 411 of the releasable connector 415 is connected to the second part 412 of the releasable connector 415. In some embodiments, the mooring system 400 can include at least one buoyancy module 422 that can be disposed at least partially about, on, and/or inside the column 130 and/or at least partially about, on and/or inside the base structure 120. In some embodiments, the buoyancy module 422 can be an internal volume of the column 130 and/or an internal volume of the base structure 120. In other embodiments, the buoyancy module 422 can be separate and apart from the column 130 and the base structure 120.

In some embodiments, the mooring system 400 can include, one, two, three, four, or more buoyancy modules 422. The buoyancy module 422 can be configured to add a buoyant force to the column 130 and/or the base structure 120 that can be 10%, 20%, or 50% to 75%, 80%, or even 100% of the weight of the base structure 120 and column 130 combined. By adding a buoyant force to the column 130 and/or base structure 120, the corresponding size and cost of the lifting devices 420 disposed on the vessel V that can be used to raise and lower the column 130, the base structure 120, and at least a portion of the mooring legs 110 during a connection operation and/or a disconnection operation from the vessel V can be significantly reduced. In some embodiments, the mooring system 400 can include the buoyancy module 422 and the bottom of the base structure 120 can also be configured as a ballast tank 121 and/or can be a solid body having a desired mass for a given mooring system 400.

In some embodiments, each buoyancy module 422 can be configured as a flexible bladder, a series of flexible bladders, and/or as a rigid fabricated structure that can be pressure balanced with the seawater pressure at the exterior of the buoyancy module 422. In some embodiments, the buoyancy module 422 can be open to the sea at a position that is below the surface of the body of water W. In such embodiment, the buoyancy module 422 can normally be filled with water such that the weight of the mooring system is at a maximum and can be filled with a liquid, a gas, or a combination of a liquid and a gas prior to the disconnection or connection of the vessel V from or to the mooring system 400 such that the weight of the column 130, base structure 120, and a portion of mooring leg 110 can be reduced during the connection or disconnection process.

In some embodiments, the buoyancy module 422 can be in fluid communication with a compressed gas source 440. The compressed gas source 440 can be disposed on the vessel V or an auxiliary or second vessel, not shown. The compressed gas source 440 can be or can include one or more compressors and/or compressed gas cylinders. The compressed gas can be air, nitrogen, natural gas, exhaust gas, or any other gas. The compressed gas source 440 can be in fluid communication with the buoyancy module 422 via a compressed gas conduit 450. In some embodiments, the compressed gas conduit 450 can be a stand-alone flexible pipe, hose, or other similar type of conduit. In other embodiments, the compressed gas conduit 450 can be disposed within a control umbilical, not shown that runs from the vessel V to the turntable 150 and through a separate utility swivel, not shown, or directly to the buoyancy module 422. In other embodiments, the buoyancy module 422 can be in fluid communication with a liquid source, not shown. The liquid can have a density that can be less than the water the mooring system 400 is disposed in. In some embodiments, the liquid can be a light hydrocarbon liquid. In still other embodiments, the buoyancy module 422 can be in fluid communication with a compressed gas source 440 and a liquid source.

In some embodiments, the amount of gas disposed inside of the buoyancy module 422 can be selected such that the column 130 and base structure 120 are stable when resting on the seabed when the vessel V has been disconnected therefrom. In some embodiments, the amount of gas disposed inside the buoyancy module can be reduced after the column 130 and base structure 120 and at least a portion of the mooring leg 110 are set down on the seabed S and/or the landing structure 470 thereby increasing the weight of the column 130 and base structure 120 provide additional stability. In some embodiments, a gas can be introduced into the buoyancy module 422 prior to reconnecting the vessel V to the mooring system 400. In some embodiments, the gas can be introduced into the buoyancy module 422 one time prior to a severe weather season, e.g., a hurricane or typhoon season, and the gas can be expelled from the buoyancy module 422 after the severe weather season has passed, e.g., after a hurricane or typhoon season.

In some embodiments, the buoyancy module 422 can be configured as a separate structure, e.g., an annular cylindrical structure, that can be at least partially disposed about the column 130 and below the surface of the body of water W that can slide, translate, or otherwise move along a portion of the column 130 from a first position at or just above the base structure 120 to a second position that is located closer to the second end 132 of the column 130. In some embodiments, the buoyancy module 422 can include a ballast material and can also include a volume within the internal volume of the buoyancy module 422 configured to receive a gas to provide a buoyant force on the system 400. In some embodiments, the buoyancy module 422 can be configured to contain a ballast material, e.g., an internal volume of the buoyancy module can at times be partially or completely filled with water, and such ballast material can be removed at times and replaced with air or other fluid having a mass less than the water when it is desired to apply a buoyant force on the system 400. In some embodiments, the dimensions of the buoyancy module 422 can be such that, when filled with a gas, the buoyancy module 422 can be buoyant and move to the second position thus imparting a buoyant force on the column 130 and the base structure 120. By imparting a buoyant force to the column 130 and/or base structure 120, the corresponding size and cost of the lifting devices 420 disposed on the vessel V that can be used to raise and lower the column 130, the base structure 120, and at least a portion of the mooring legs 110 during a connection operation and/or a disconnection operation from the vessel V can be significantly reduced. As such, in some embodiments, the buoyancy module 422 can impart additional weight to the system 400 by containing ballast material, can impart a buoyant force to the system 400 by containing a buoyant material, e.g., air, or can be configured to be neutrally buoyant depending on the amount of ballast material and the amount of buoyant material, e.g., air, contained within the buoyancy module 422.

Figure 5:
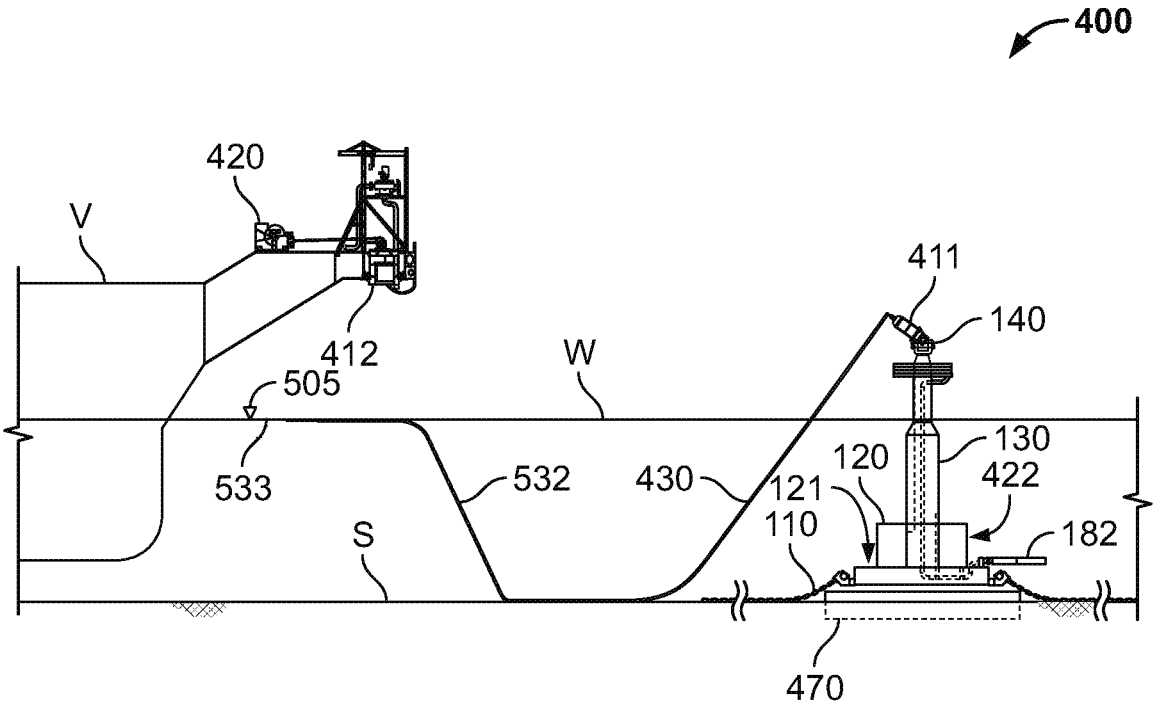
FIGS. 5-9 depict an illustrative process for mooring a vessel floating on a surface of a body of water to an illustrative mooring system, according to one or more embodiments described.
Figure 6:
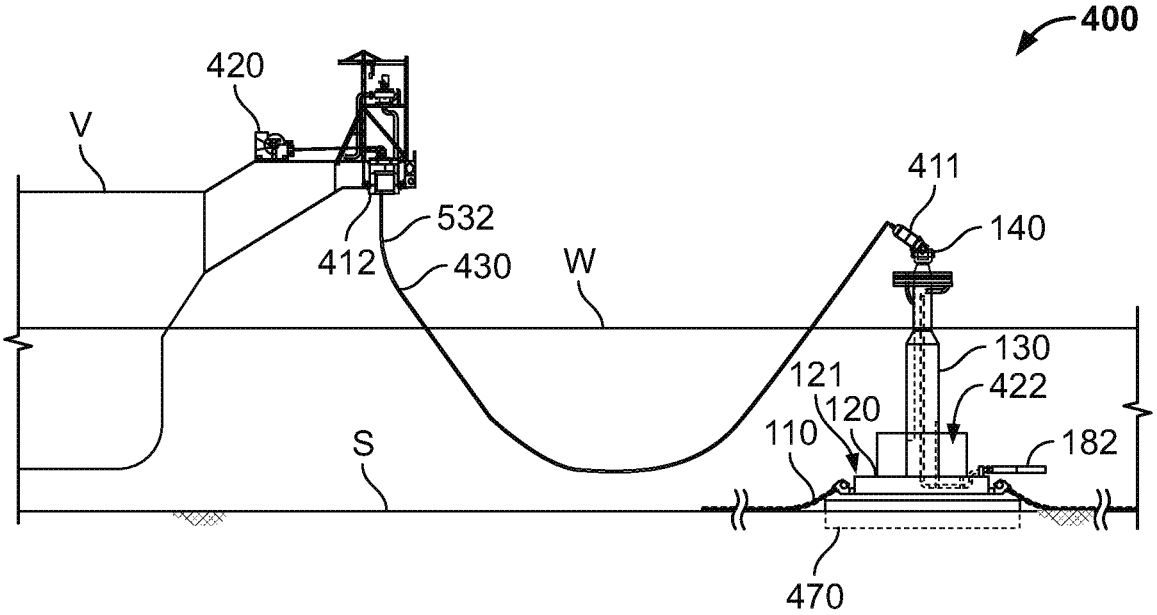
Figure 7:
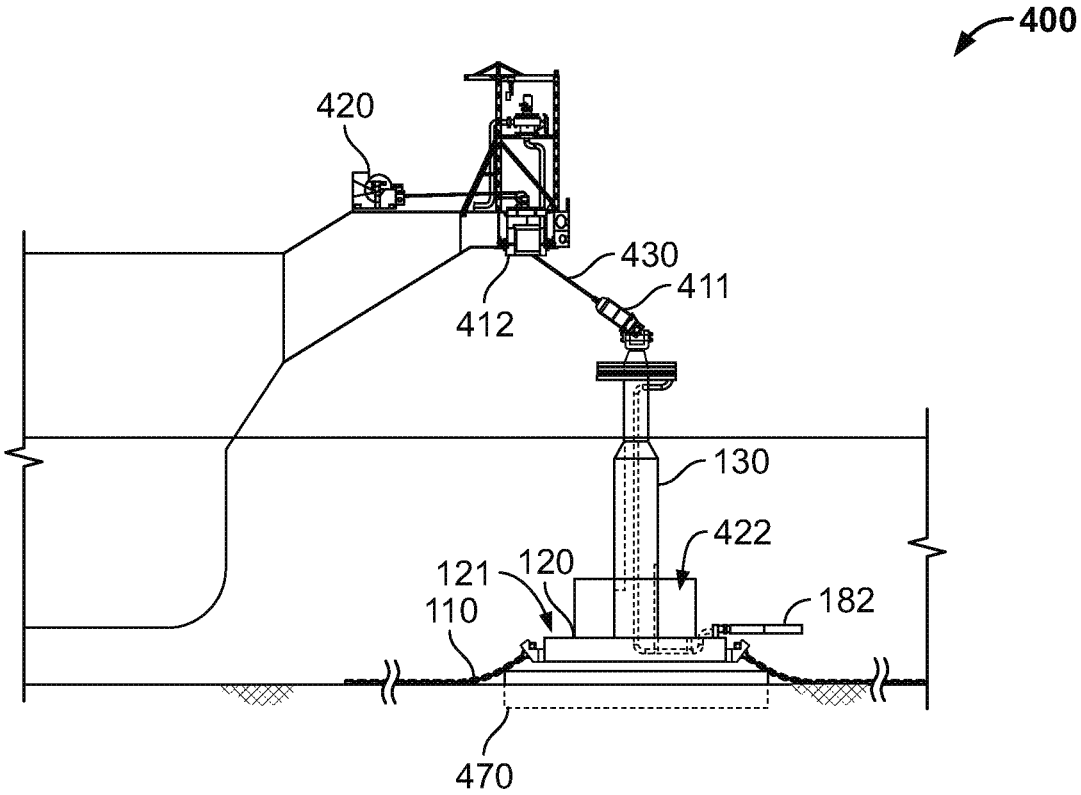
Figure 8:
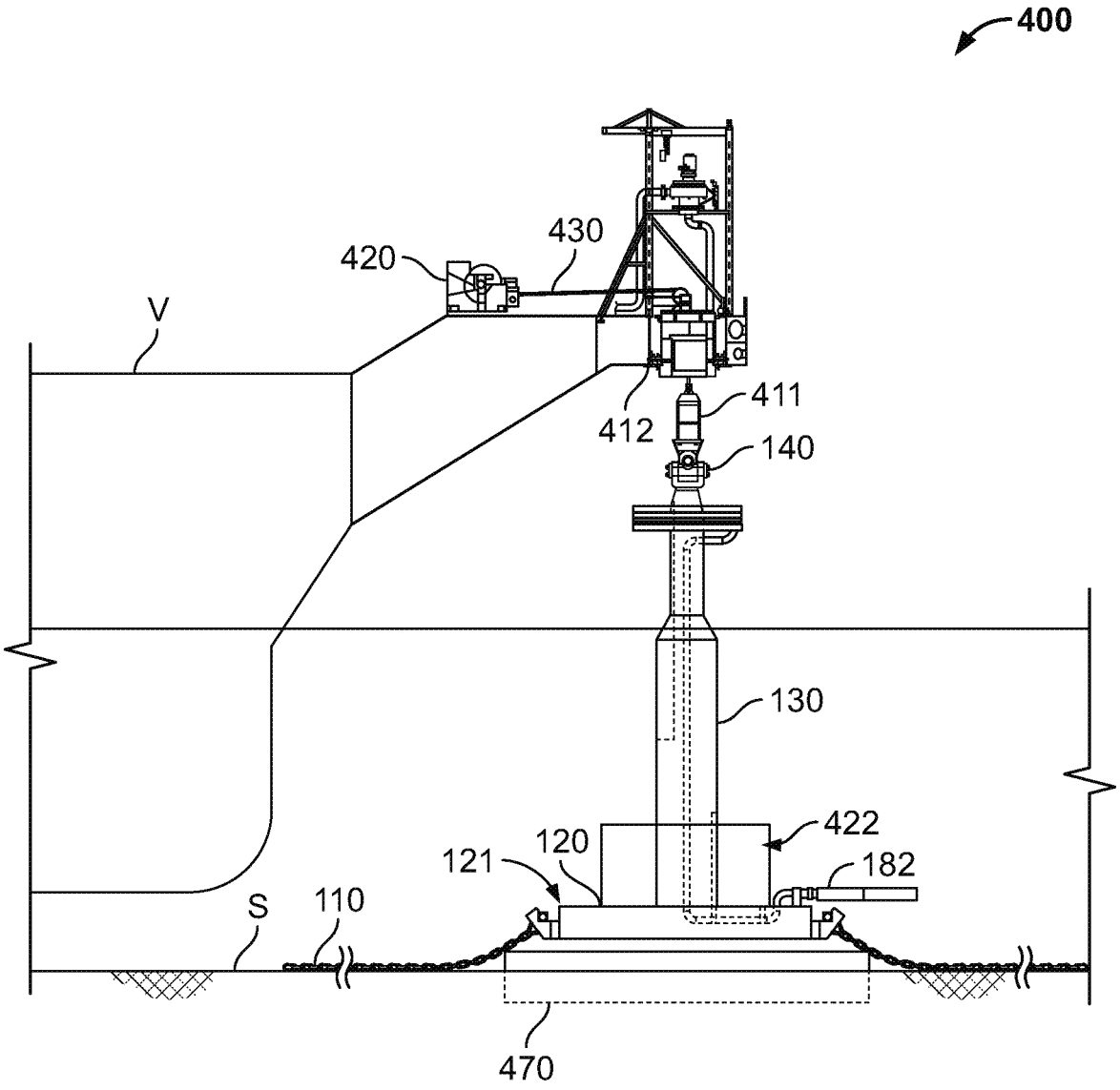
Figure 9:
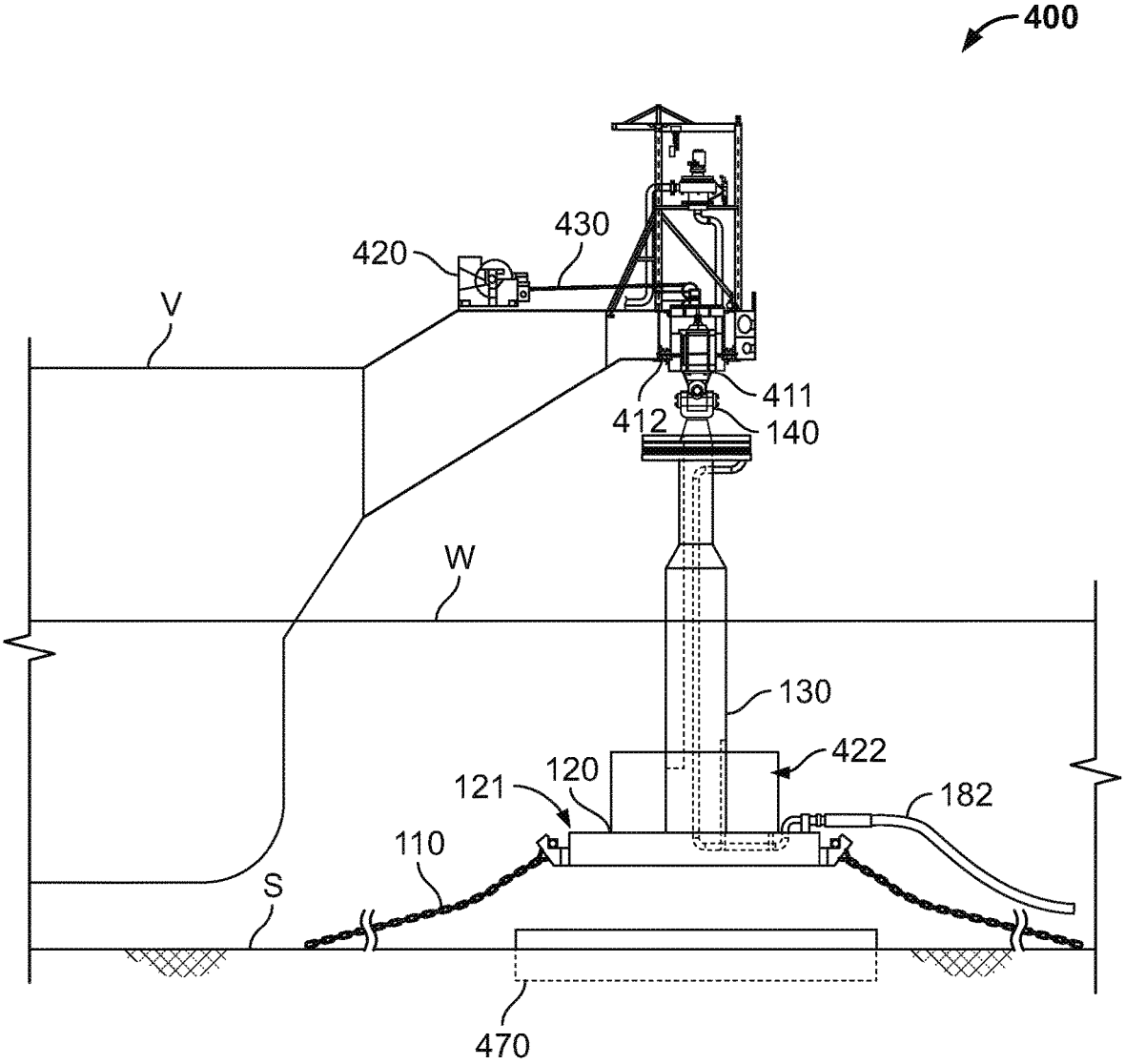
Figure 10:
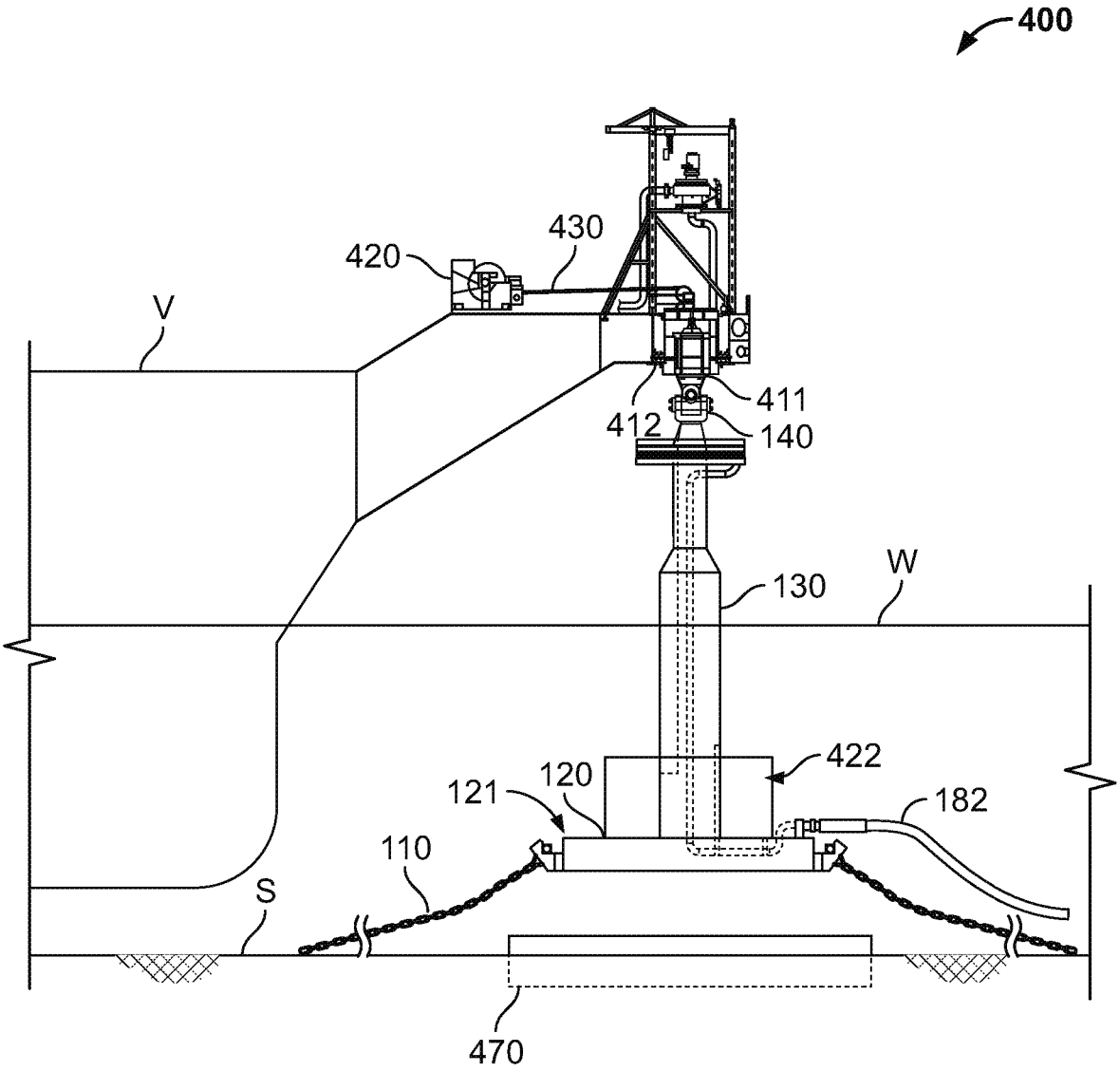
FIGS. 10-14 depict an illustrative process for unmooring a vessel floating on a surface of a body of water from an illustrative mooring system, according to one or more embodiments described.
Figure 11:
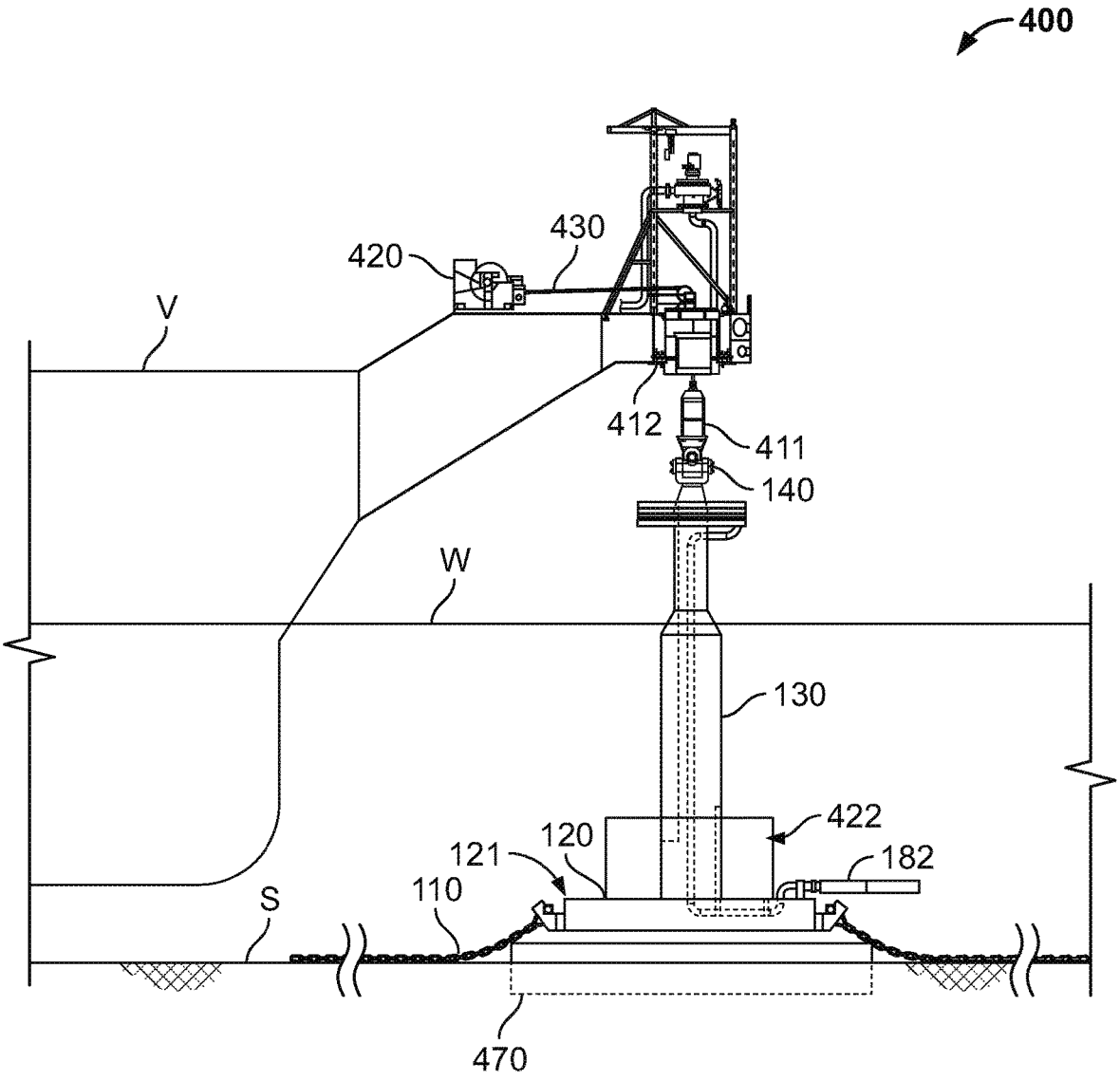
Figure 12:
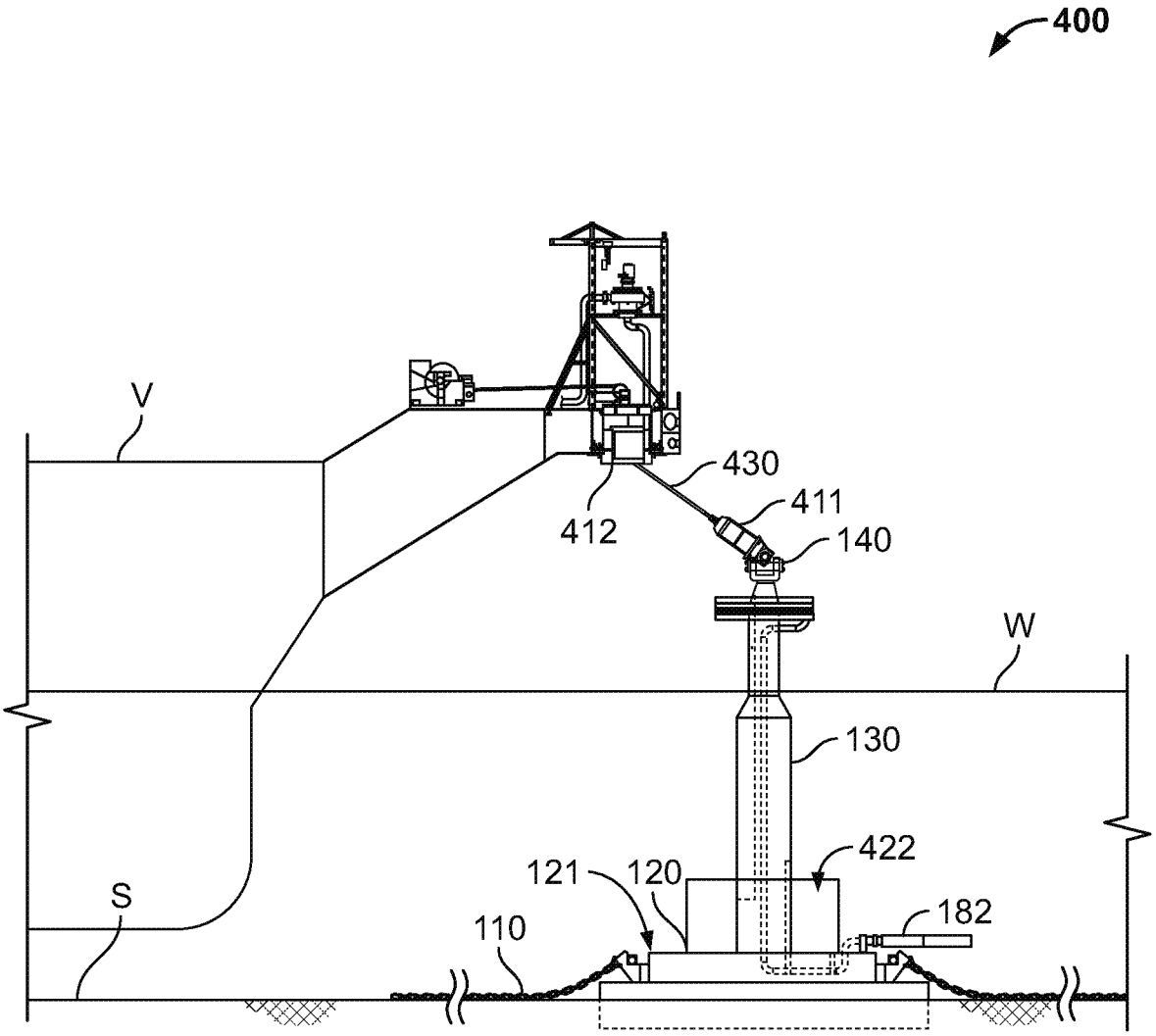
Figure 13:
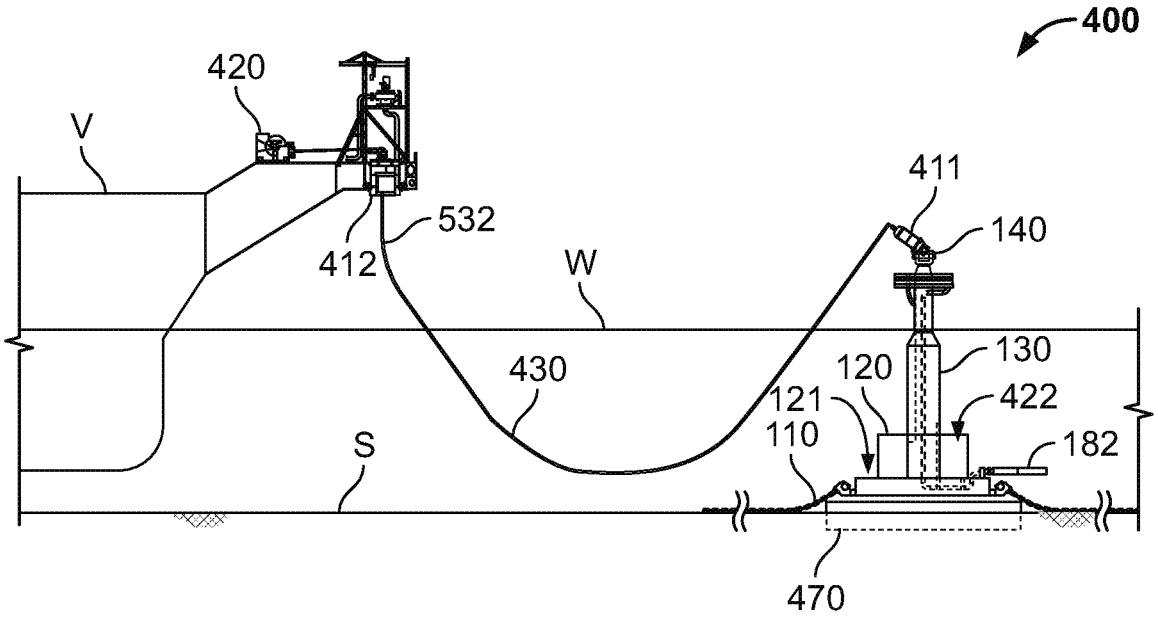
Figure 14:
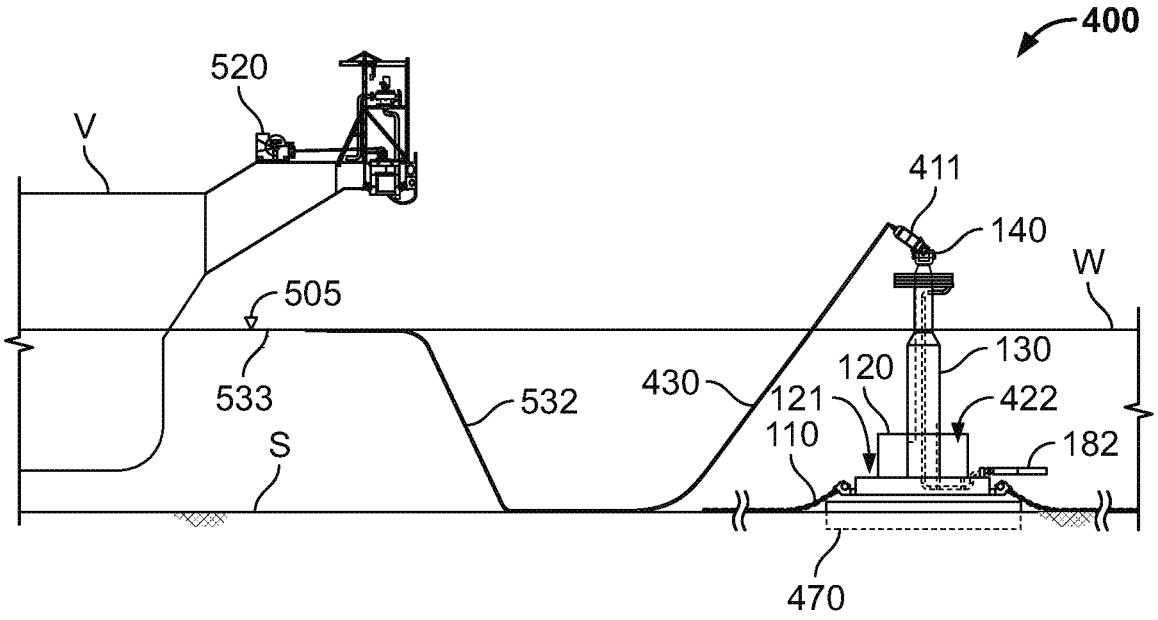

FIGS. 5-9 depict an illustrative process for mooring a vessel V floating on a surface of a body of water to the mooring system 400, according to one or more embodiments. The compressed gas source 440 and the compressed gas conduit 450 shown in FIG. 4 have been omitted. In some embodiments the process can include positioning the vessel V near the mooring system 400 that can be disposed on or connected to the seabed S or optional landing structure 470. The vessel V or a support vessel can retrieve a retrieval line 532 and/or lifting line 430. The retrieval line 532 and/or the lifting line 430 can be hauled in with a lifting device 420 disposed on the vessel V. As shown in FIG. 5, a buoy 505 can be disposed at the end 533 of the retrieval line 532 to maintain the end 533 of the retrieval line 532 on the surface of the body of water W. As the lifting device 420 hauls in the retrieval line 532 and/or lifting line 430, the vessel V can move toward the mooring system 400. The vessel V can continue to haul in the retrieval line 532 and/or lifting line 430 with the lifting device 420 until the first component 411 of the releasable connector 415 is located adjacent to or otherwise in an engagement position with respect to the second component 412 of the releasable connector 415 that can be connected to the fixed part 151 of the turntable 150. The first component 411 of the releasable connector 415 can be connected to the second component 412 of the releasable connector 415 to secure the vessel V to the mooring system 400. In some embodiments, the flexible pipe segment 183 (see FIG. 2) can be connected to the swivel 160 once the first component 411 has been connected to the second component 412 of the releasable connector 415.

In some embodiments, prior to lifting the column 130, at least a portion of the base structure 120, and at least a portion of the mooring legs 110 off of the seabed S or off of the optional landing structure 470, the one or more buoyancy modules 422, can be filled with a gas via the compressed gas source 440 and compressed gas conduit 450 (see FIG. 4) to apply a buoyant force to the column 130, base structure 120, and at least a portion of the mooring legs 110. In some embodiments, a gas can be introduced into the buoyancy module 422 by connecting the buoyancy module 422 to a compressed gas source, e.g., the gas compressor 440 shown in FIG. 4. In some embodiments, the buoyancy module 422 can be a rigid structure and the gas can displace a liquid disposed inside of the buoyancy module 422 into the body of water. In other embodiments, the buoyancy module 422 can be a flexible bladder, not shown and the gas can fill the buoyancy module 422. In some embodiments, at least a portion of the gas within the buoyancy module 422 can be evacuated from the buoyancy module 422 after the first part 411 of the releasable connector 415 and second part 412 of the releasable connector 415 have been connected to one another. In some embodiments, the gas within the buoyancy module 422 can be displaced by a portion of the body of water after the first part 411 of the releasable connector 415 and second part 412 of the releasable connector 415 have been connected to one another.

FIGS. 10-14 depict an illustrative process for unmooring a vessel V floating on a surface of a body of water W from the mooring system 400, according to one or more embodiments. The compressed gas source 440 and the compressed gas conduit 450 shown in FIG. 4 have been omitted. In some embodiments, the flexible pipe segment 183 (see FIG. 2) can be disconnected from the swivel 160 and secured to the column 130, e.g., to the second end 132 of the column 130. In some embodiments, the first end 431 of the lifting line 430 can be connected to the first component 411 of the releasable connector 415. In some embodiments, the first component 411 of the releasable connector 415 can be released or disconnected from the second component 412 of the releasable connector 415. In some embodiments, the lifting device 420 can apply a tension to the lifting line 430 to remove at least a portion of a tension load from the releasable connector 415 prior to releasing the releasable connector 415.

In some embodiments, the lifting device 420 and the lifting line 430 can be used to lower the column 130, the base structure 120, and at least a portion of the mooring legs 110 toward the seabed S and/or an optional landing structure 470 such that the base structure 120 can at sit on the seabed S and/or the landing structure 470. In some embodiments, the lifting line 430 can be further lowered with the lifting device 420 using a retrieval line 532. The lifting line 430 and/or retrieval line 532 can then be disconnected from the lifting device 420 and the vessel V can then be free from the mooring system 400. The vessel V is then free to maneuver away from the mooring system 400.

In some embodiments, prior to lowering the column 130, base structure 120, and at least a portion of the mooring legs 110 toward the seabed S or the optional landing structure 470, the one or more buoyancy modules 422, can be filled with a gas to apply a buoyant force to the column 130, base structure 120 and at least a portion of the mooring legs 110. In some embodiments, a gas can be introduced into the buoyancy module 422 by connecting the buoyancy module 422 to the compressed gas source 440 via compressed gas line 450 as shown in FIG. 4. In some embodiments, the buoyancy module 422 can be a rigid structure and the gas can displace a liquid disposed inside of the buoyancy module 422 into the body of water. In other embodiments, the buoyancy module can be a flexible bladder, not shown and the gas can fill the buoyancy module. In some embodiments, the gas within the buoyancy module 422 can be evacuated from the buoyancy module 422 after the base structure 120 has been set down or laid on the seabed S and/or the optional landing structure 470. In some embodiments, the gas within the buoyancy module 422 can be displaced by a portion of the body of water after the base structure 120, the column 130, and at least a portion of the mooring legs 110 have been set on the seabed S and/or the optional landing structure 470. In some embodiments, the mooring system 400 can be free from any requirement that the vessel V have a certain heading requirement for the vessel V to be moored to or unmoored from the mooring system 400.

Figure 15:
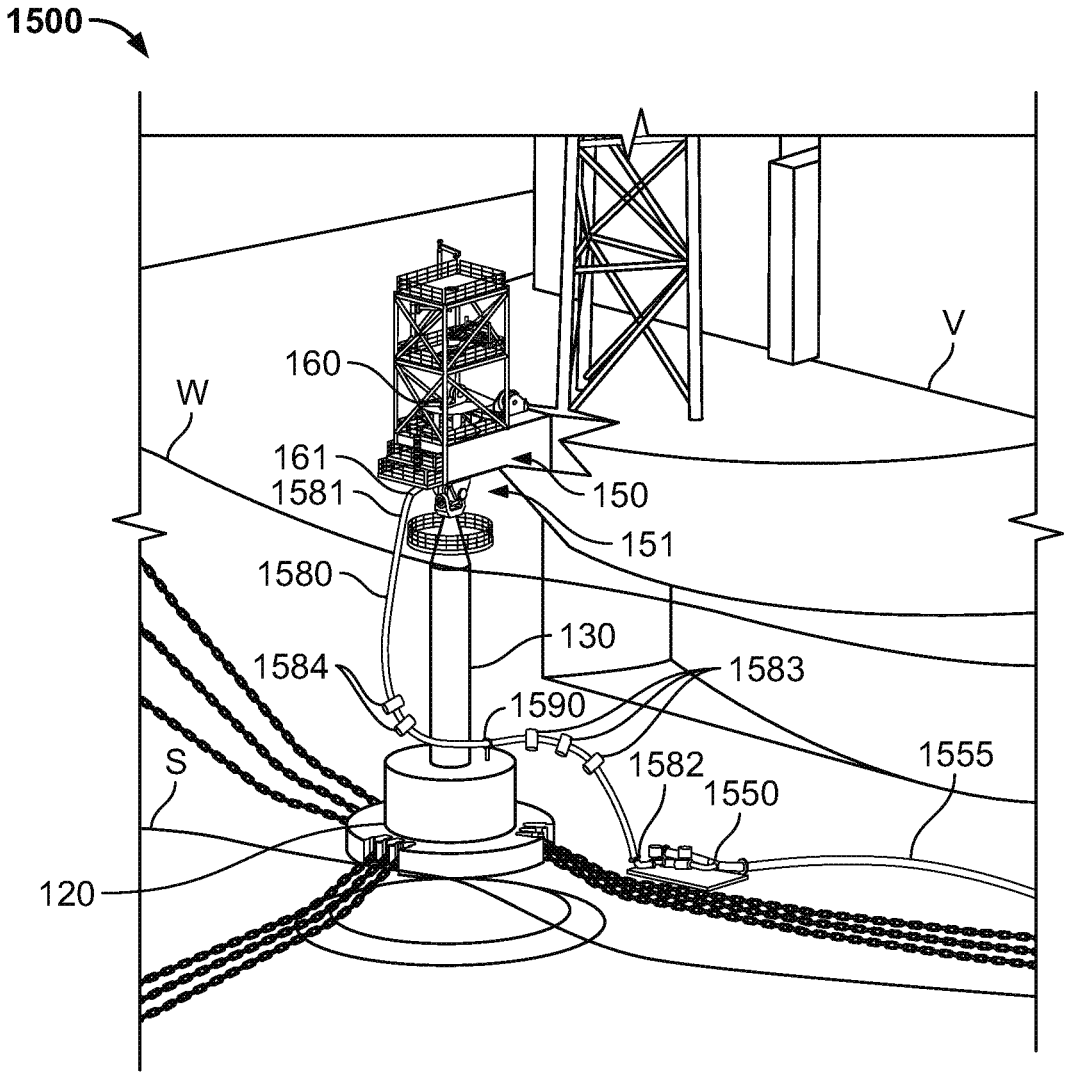
FIG. 15 depicts an isometric view of an illustrative mooring system for mooring a vessel floating on a surface of a body of water having a flexible conduit and a guide disposed on a base structure, according to one or more embodiments described.

FIG. 15 depicts an isometric view of an illustrative mooring system 1500 for mooring a vessel V floating on a surface of a body of water W that includes one or more flexible conduits 1580 and, optionally, one or more guides 1590 disposed on the base structure 120, according to one or more embodiments. The flexible conduit 1580 can have a first end 1581 in fluid communication with the fixed part 161 of the swivel 160 and a second end 1582 in fluid communication with an optional pipeline end manifold 1550, as shown, or directly to a pipeline 1555. The flexible conduit 1580 can be any type of hose or flexible pipe, hose, or other elongated member that is compatible with the operating conditions. In some embodiments, the flexible conduit 1580 can be configured to convey a gas, a liquid, electricity, optical signals, or any combination thereof. In some embodiments, the flexible conduit 1580 can be fabricated from rubber, one or more polymers or the like.

In some embodiments the flexible conduit 1580 can be configured in a compliant shape such that the first end 1581 of the flexible conduit 1580 can remain connected to or in fluid communication with the conduit 161 disposed on the fixed part 151 of the turntable 150 and the second end 1582 of the flexible conduit 1580 can remain connected to or in fluid communication with the pipeline end manifold 1550 or the pipeline 1555 as the vessel V moves relative to the pipeline 1555 and/or the pipeline end manifold 1550.

In some embodiments, the compliant shape of the flexible conduit 1580 can be a pliant wave, a lazy wave, a steep wave, a Chinese lantern shape, a semi helical shape, or any other shape that can provide the necessary slack length of the flexible conduit 1580 to accommodate the maximum anticipated relative movement between the vessel V and the pipeline end manifold 1550 or pipeline 1555 while maintaining the flexible conduit 1580 in a stable configuration such that it is not over stressed or otherwise damaged as a result of the vessel V moving relative to the pipeline end manifold 1550 or the pipeline 1555. In some embodiments, at least one float 1583 and/or at least one weight 1584 can be connected to the exterior of the flexible conduit 1580, two weights 1584 and three floats 1583 are shown. The at least one float 1583 and the at least one weight 1584 can be configured to urge the flexible conduit 1580 into the desired compliant shape.

Figure 16:
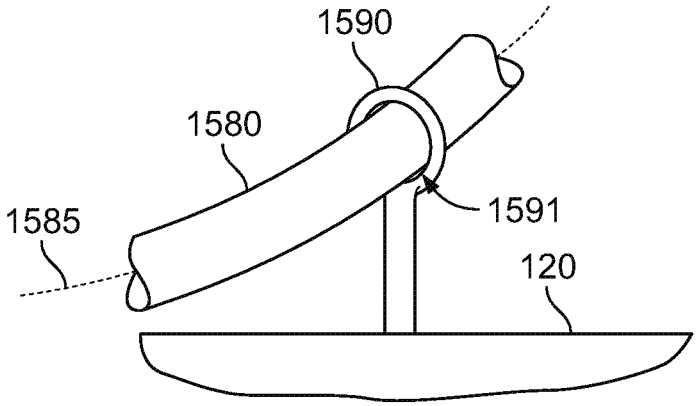
FIG. 16 depicts a detailed isometric view of an illustrative guide, according to one or more embodiments described.

FIG. 16 depicts a detailed isometric view of the guide 1590, according to one or more embodiments. The guide 1590 can be disposed on or affixed to the base structure 1520 as shown or on the column 130, not shown. In some embodiments, the guide 1590 can be a steel fabricated structure that defines an aperture 1591 through which the flexible conduit 1580 can pass. The guide 1590 can at least partially constrain the flexible conduit 1580 in a radial direction. The guide 1590 can be configured such that the flexible conduit 1580 is not constrained or is free to move relative to the guide 1590 along a longitudinal axis 1585 of the flexible conduit 1580.

In some embodiments, an inner surface of the aperture defined by the guide 1590 can include a smooth, low friction surface. In some embodiments, the inner surface of the aperture can be coated with a polymer, e.g., high density polyethylene, ultra-high molecular weight polyethylene, polymer material sold under the name ORKOT® and available from Trelleborg, or other similar friction reducing coatings. In other embodiments, an exterior of the flexible conduit 1580 can be provided with a reinforcement at least along a length of the flexible conduit 1580 that is anticipated to move through the aperture defined by the guide 1590 when the vessel V is moored to the mooring system 1500. In some embodiments, the reinforcement can include a metal shield, a woven wire shield, or other semi rigid and durable material relative to the material the fluid conduit 1580 can be mainly fabricated from.

As shown, the guide 1590 can include a continuous ring that defines the aperture 1591. In other embodiments, however, the guide 1590 can include two or more segments that can be coupled together to form the aperture 1591, which can facilitate location of the flexible conduit 1580 therein via one or more underwater divers, a remotely operated vehicle, or the like. It should also be understood that the mooring system 1500 can include 1, 2, 3, 4, 5, 6, 7, 8, 9, 10, or more guides 1590 disposed on the base structure 120 and/or the column 130. It should also be understood that one or more retaining lines (not shown) can be connected to the base structure 120 and/or the column 130 that can also be connected to the flexible conduit 1580 to limit a distance the flexible conduit 1580 can move away from the base structure 120 and/or the column 130.

The present disclosure further relates to any one or more of the following numbered embodiments:

1. A mooring system for mooring a vessel floating on a surface of a body of water, comprising: a base structure; a mooring leg having a first end configured to be attached to a seabed and a second end configured to be attached to the base structure; a column having a first end attached to the base structure; and a turntable comprising a rotating part rotatively coupled to a fixed part, wherein a second end of the column is configured to be connected to the fixed part of the turntable via a multi-axis joint, wherein the rotating part of the turntable is configured to be connected to the vessel such that the vessel is rotatable with respect to the column when the second end of the column is connected to the fixed part of the turntable, and wherein the base structure is configured to be elevated above the seabed when the second end of the column is connected to the fixed part of the turntable.
2. The mooring system of paragraph 1, wherein the multi-axis joint is a dual axis joint configured to permit the column to pivot relative to the fixed part of the turntable about two axes that are substantially orthogonal or substantially perpendicular to one another when the second end of the column is connected to the fixed part of the turntable.
3. The mooring system of paragraph 1 or paragraph 2, wherein the base structure and/or the column comprises a weight.
4. The mooring system of paragraph 3, wherein the weight is a ballast tank configured to contain a ballast material.
5. The mooring system of any one of paragraphs 1 to 4, further comprising: a releasable connector comprising a first component connected to the multi-axis joint and a second component connected to the fixed part of the turntable; a lifting device configured to be disposed on the vessel; and a lifting line having a first end configured to be connected to the first component of the releasable connector and a second end configured to be connected to the lifting device, and wherein the lifting device and the lifting line are configured to lift the column, the base structure, and a portion of the mooring leg toward the fixed part of the turntable to move the first component of the releasable connector into an engagement position with respect to the second component of the releasable connector.
6. The mooring system of paragraph 5, wherein the lifting device and the lifting line are configured to lower the column, the base structure, and the portion of the mooring leg toward the seabed to move the first component of the releasable connector into an unengaged position with respect to the second component of the releasable connector.

7. The mooring system of paragraph 6, wherein the base structure is configured to be set on the seabed when the first component of the releasable connector is in the unengaged position with respect to the second component of the releasable connector.

8. The mooring system of paragraph 6, further comprising a landing structure configured to be disposed on the seabed, wherein the base structure is configured to be at least partially set on the landing structure when the first component of the releasable connector is in the unengaged position with respect to the second component of the releasable connector.

9. The mooring system of any one of paragraphs 1 to 8, further comprising a buoyancy module configured to increase a buoyancy of the column and the base structure and to reduce a buoyancy of the column and the base structure, wherein an internal volume of the buoyancy module is configured to be in fluid communication with the body of water such that the internal volume of the buoyancy module comprises a portion of the body of water when the mooring system is located in the body of water.

10. The mooring system of paragraph 9, further comprising a compressed gas source and a gas conduit, wherein a first end of the gas conduit is configured to be in fluid communication with the compressed gas source and a second end of the gas conduit is configured to be in fluid communication with the internal volume of the buoyancy module, and wherein, when the mooring system is located in the body of water, the compressed gas source and the gas conduit are configured to convey a gas into the internal volume of the buoyancy module to displace at least a portion of the water in the internal volume of the buoyancy module into the body of water to increase a buoyancy of the column and the base structure.

11. The mooring system of paragraph 9 or paragraph 10, wherein the buoyance module is at least partially disposed about the column, and wherein the buoyancy module is configured to move along a portion of the column from a first position located toward the base structure toward a second position located toward the second end of the column when the buoyancy module increases the buoyancy of the column and the base structure.

12. The mooring system of any one of paragraphs 5 to 11, wherein the lifting device comprises a chain jack, a strand jack, a linear winch, a rotary winch, or a combination thereof.

13. The mooring system of any one of paragraphs 1 to 12, further comprising a fluid swivel comprising a first part rotatively coupled to a second part and configured to maintain fluid communication between the first part of the fluid swivel and the second part of the fluid swivel when the second part of the fluid swivel rotates relative to the first part of the fluid swivel, and wherein the first part of the fluid swivel is connected to the fixed part of the turntable and the second part of the fluid swivel is connected to the rotating part of the turntable or the vessel; a first fluid conduit having a first end configured to be in fluid communication with a pipeline disposed on the seabed and a second end configured to be in fluid communication with the fixed part of the fluid swivel; and a second fluid conduit having a first end configured to be in fluid communication with the rotating part of the fluid swivel and a second end configured to be in fluid communication with the vessel.

14. The mooring system of paragraph 13, further comprising a guide disposed on the column or the base structure, wherein the guide defines an aperture, wherein a portion of the first fluid conduit is disposed within the aperture defined by the guide, and wherein at least the portion of the first fluid conduit disposed within the aperture defined by the guide is a flexible fluid conduit.

15. The mooring system of paragraph 13 or paragraph 14, wherein the first fluid conduit is at least partially constrained in a radial direction of the first fluid conduit by the guide, and wherein the first fluid conduit is free to move in a longitudinal direction of the first fluid conduit relative to the guide.

16. The mooring system of any one of paragraphs 13 to 15, further comprising a float and/or a weight configured to be connected to an exterior surface of the first fluid conduit and configured to urge the first fluid conduit into a compliant shape.

17. The mooring system of any one of paragraphs 13 to 16, wherein the first fluid conduit comprises a rigid fluid conduit and a flexible fluid conduit.

18. The mooring system of any one of paragraphs 13 to 17, wherein the first end of the first fluid conduit is configured to be in fluid communication with the pipeline disposed on the seabed via a pipeline end manifold.

19. The mooring system of any one of paragraphs 1 to 12, further comprising a swivel comprising a first part rotatively coupled to a second part and configured to maintain communication between the first part of the swivel and the second part of the swivel when the second part of the swivel rotates relative to the first part of the swivel, and wherein the first part of the swivel is connected to the fixed part of the turntable and the second part of the swivel is connected to the rotating part of the turntable or the vessel.

20. The mooring system of paragraph 19, wherein the first part and the second part of the swivel are configured to maintain fluid communication, electrical communication, optical communication, or a combination thereof therebetween.

21. The mooring system of any one of paragraphs 1 to 20, wherein the first end of the mooring leg is configured to be attached to the seabed via a drag embedment anchor, a gravity anchor, a suction pile, a driven pile, or a combination thereof 22. The mooring system of any one of paragraphs 1 to 21, wherein the mooring leg comprises a segment of chain, a segment of wire rope, a segment of synthetic rope, or a combination thereof 23. The mooring system of any one of paragraphs 1 or 3 to 22, 31, wherein the multi-axis joint comprises a ball and socket joint.

24. A process for mooring a vessel floating on a surface of a body of water to a mooring system, comprising: positioning the vessel near the mooring system, wherein the mooring system comprises: a base structure sitting on a seabed, a mooring leg having a first end attached to the seabed and a second end attached to the base structure, a column having a first end attached to the base structure and a second end attached to a multi-axis joint, a turntable comprising a rotating part rotatively coupled to a fixed part, wherein the rotating part of the turntable is connected to the vessel, a releasable connector comprising a first component connected to the multi-axis joint and a second component connected the fixed part of the turntable, a lifting device disposed on the vessel, and a lifting line having a first end connected to the second component of the releasable connector and a second end configured to be connected to the lifting device; connecting the second end of the lifting line to the lifting device; hauling in the lifting line with the lifting device to lift the column, the base structure, and at least a portion of the mooring leg to move the first component of the releasable connector into an engagement position with respect to the second component of the releasable connector; and connecting the first component of the releasable connector to the second component of the releasable connector to secure the vessel to the mooring system, wherein the base structure is elevated above the seabed and the vessel is rotatable with respect to the column when the first and second components of the releasable connector are connected to one another.

25. The process of paragraph 24, wherein the mooring system further comprises a gas conduit, a compressed gas source, and a buoyancy module, and wherein an internal volume of the buoyancy module is in fluid communication with and contains a portion of the body of water, the process further comprising at least partially filling the internal volume of the buoyancy module with a gas from the compressed gas source via the gas conduit to increase a buoyancy of the column and the base structure prior to and/or during hauling in of the lifting line with the lifting device.

26. The process of paragraph 25, further comprising at least partially filling an internal volume of the buoyancy module with a water from the body of water after the first component of the releasable connector is connected to the second component.

27. A process for unmooring a vessel floating on a surface of a body of water from a mooring system, comprising: releasing a releasable connector, wherein the mooring system comprises: a base structure elevated above of the seabed, a mooring leg having a first end attached to the seabed and a second end attached to the base structure, a column having a first end attached to the base structure and a second end attached to a multi-axis joint, a turntable comprising a rotating part rotatively coupled to a fixed part, wherein the rotating part of the turntable is connected to the vessel, wherein the releasable connector comprises a first component connected to the multi-axis joint and a second component connected the fixed part of the turntable such that the vessel is rotatable with respect to the column when the first and second components of the releasable connector are connected to one another, a lifting device disposed on the vessel, and a lifting line having a first end connected to the first component of the releasable connector and a second end connected to the lifting device, lowering the column, the base structure, and a portion of the mooring leg toward the seabed with the lifting line and the lifting device such that the base structure is supported by the seabed; disconnecting the second end of the lifting line from the lifting device; and maneuvering the vessel away from the mooring system.

28. The process of paragraph 27, wherein the mooring system further comprises a compressed gas source, a gas conduit, and a buoyancy module, and wherein an internal volume of the buoyancy module is in fluid communication with and contains a portion of the body of water, the process further comprising at least partially filling the internal volume of the buoyancy module with a gas from the compressed gas source via the gas conduit to increase a buoyancy of the column and the base structure prior to releasing the releasable connector.

29. The process of paragraph 27 or paragraph 28, further comprising at least partially filling an internal volume of the column with a liquid after the releasable connector is released.

30. The process of any one of paragraphs 27 to 29, further comprising applying a tension to the lifting line with the lifting device to remove at least a portion of a tension load from the releasable connector prior to releasing the releasable connector.

Certain embodiments and features have been described using a set of numerical upper limits and a set of numerical lower limits. It should be appreciated that ranges including the combination of any two values, e.g., the combination of any lower value with any upper value, the combination of any two lower values, and/or the combination of any two upper values are contemplated unless otherwise indicated. Certain lower limits, upper limits and ranges appear in one or more claims below. All numerical values are "about" or "approximately" the indicated value, and take into account experimental error and variations that would be expected by a person having ordinary skill in the art.

Various terms have been defined above. To the extent a term used in a claim can be not defined above, it should be given the broadest definition persons in the pertinent art have given that term as reflected in at least one printed publication or issued patent. Furthermore, all patents, test procedures, and other documents cited in this application are fully incorporated by reference to the extent such disclosure can be not inconsistent with this application and for all jurisdictions in which such incorporation can be permitted.

While certain preferred embodiments of the present invention have been illustrated and described in detail above, it can be apparent that modifications and adaptations thereof will occur to those having ordinary skill in the art. It should be, therefore, expressly understood that such modifications and adaptations may be devised without departing from the basic scope thereof, and the scope thereof can be determined by the claims that follow.

What is claimed is:

1. A mooring system for mooring a vessel floating on a surface of a body of water, comprising:

a base structure;

a mooring leg having a first end configured to be attached to a seabed and a second end configured to be attached to the base structure;

a column having a first end attached to the base structure; and a turntable comprising a rotating part rotatively coupled to a fixed part, wherein:

a second end of the column is configured to be connected to the fixed part of the turntable via a dual axis joint, the rotating part of the turntable is configured to be connected to the vessel such that the vessel is rotatable with respect to the column when the second end of the column is connected to the fixed part of the turntable, the base structure is configured to be elevated above the seabed when the second end of the column is connected to the fixed part of the turntable, and the base structure is configured to sit on the seabed when the second end of the column is disconnected from the fixed part of the turntable.

2. The mooring system of claim 1, wherein the dual axis joint is configured to permit the column to pivot relative to the fixed part of the turntable about two axes that are substantially orthogonal or substantially perpendicular to one another when the second end of the column is connected to the fixed part of the turntable.

3. The mooring system of claim 1, wherein the base structure and/or the column comprises a weight.

4. The mooring system of claim 3, wherein the weight is a ballast tank configured to contain a ballast material.

5. The mooring system of claim 1, further comprising:

a releasable connector comprising a first component connected to the dual axis joint and a second component connected to the fixed part of the turntable;

a lifting device configured to be disposed on the vessel; and a lifting line having a first end configured to be connected to the first component of the releasable connector and a second end configured to be connected to the lifting device, and wherein the lifting device and the lifting line are configured to lift the column, the base structure, and a portion of the mooring leg toward the fixed part of the turntable to move the first component of the releasable connector into an engagement position with respect to the second component of the releasable connector.

6. The mooring system of claim 5, wherein the lifting device and the lifting line are configured to lower the column, the base structure, and the portion of the mooring leg toward the seabed to move the first component of the releasable connector into an unengaged position with respect to the second component of the releasable connector.

7. The mooring system of claim 6, wherein the base structure is configured to be set on the seabed when the first component of the releasable connector is in the unengaged position with respect to the second component of the releasable connector.

8. The mooring system of claim 6, further comprising a landing structure configured to be disposed on the seabed, wherein the base structure is configured to be at least partially set on the landing structure when the first component of the releasable connector is in the unengaged position with respect to the second component of the releasable connector.

9. The mooring system of claim 5, wherein the lifting device comprises a chain jack, a strand jack, a linear winch, a rotary winch, or a combination thereof.

10. The mooring system of claim 1, further comprising a buoyancy module configured to increase a buoyancy of the column and the base structure and to reduce a buoyancy of the column and the base structure, wherein an internal volume of the buoyancy module is configured to be in fluid communication with the body of water such that the internal volume of the buoyancy module comprises a portion of the body of water when the mooring system is located in the body of water.

11. The mooring system of claim 10, further comprising a compressed gas source and a gas conduit, wherein a first end of the gas conduit is configured to be in fluid communication with the compressed gas source and a second end of the gas conduit is configured to be in fluid communication with the internal volume of the buoyancy module, and wherein, when the mooring system is located in the body of water, the compressed gas source and the gas conduit are configured to convey a gas into the internal volume of the buoyancy module to displace at least a portion of the water in the internal volume of the buoyancy module into the body of water to increase a buoyancy of the column and the base structure.

12. The mooring system of claim 1, further comprising a swivel comprising a first part rotatively coupled to a second part and configured to maintain communication between the first part of the swivel and the second part of the swivel when the second part of the swivel rotates relative to the first part of the swivel, and wherein the first part of the swivel is connected to the fixed part of the turntable and the second part of the swivel is connected to the rotating part of the turntable or the vessel.

13. The mooring system of claim 1, further comprising a fluid swivel having a first part rotatively coupled to a second part and configured to maintain fluid communication between the first part of the swivel and the second part of the swivel when the second part of the swivel rotates relative to the first part of the swivel, and wherein the first part of the swivel is connected to the fixed part of the turntable and the second part of the swivel is connected to the rotating part of the turntable or the vessel;

a first fluid conduit having a first end configured to be in fluid communication with a pipeline disposed on the seabed and a second end configured to be in fluid communication with the fixed part of the fluid swivel; and a second fluid conduit having a first end configured to be in fluid communication with the rotating part of the fluid swivel and a second end configured to be in fluid communication with the vessel.

14. The mooring system of claim 13, further comprising a guide disposed on the column or the base structure, wherein the guide defines an aperture, wherein a portion of the first fluid conduit is disposed within the aperture defined by the guide, and wherein at least the portion of the first fluid conduit disposed within the aperture defined by the guide is a flexible fluid conduit.

15. The mooring system of claim 14, wherein the first fluid conduit is at least partially constrained in a radial direction of the first fluid conduit by the guide, and wherein the first fluid conduit is free to move in a longitudinal direction of the first fluid conduit relative to the guide.

16. The mooring system of claim 13, further comprising a float and/or a weight configured to be connected to an exterior surface of the first fluid conduit and configured to urge the first fluid conduit into a compliant shape.

17. A process for mooring a vessel floating on a surface of a body of water to a mooring system, comprising:

positioning the vessel near the mooring system, wherein the mooring system comprises:

a base structure sitting on a seabed, a mooring leg having a first end attached to the seabed and a second end attached to the base structure, a column having a first end attached to the base structure and a second end attached to a dual axis joint, a turntable comprising a rotating part rotatively coupled to a fixed part, wherein the rotating part of the turntable is connected to the vessel, a releasable connector comprising a first component connected to the dual axis joint and a second component connected the fixed part of the turntable, a lifting device disposed on the vessel, and a lifting line having a first end connected to the second component of the releasable connector and a second end configured to be connected to the lifting device;

connecting the second end of the lifting line to the lifting device;

hauling in the lifting line with the lifting device to lift the column, the base structure, and at least a portion of the mooring leg to move the first component of the releasable connector into an engagement position with respect to the second component of the releasable connector; and connecting the first component of the releasable connector to the second component of the releasable connector to secure the vessel to the mooring system, wherein the base structure is elevated above the seabed and the vessel is rotatable with respect to the column when the first and second components of the releasable connector are connected to one another.

18. The process of claim 17, wherein the mooring system further comprises a gas conduit, a compressed gas source, and a buoyancy module, and wherein an internal volume of the buoyancy module is in fluid communication with and contains a portion of the body of water, the process further comprising at least partially filling the internal volume of the buoyancy module with a gas from the compressed gas source via the gas conduit to increase a buoyancy of the column and the base structure prior to and/or during hauling in of the lifting line with the lifting device.

19. The process of claim 18, further comprising at least partially filling an internal volume of the buoyancy module with a water from the body of water after the first component of the releasable connector is connected to the second component.

20. A process for unmooring a vessel floating on a surface of a body of water from a mooring system, comprising:

releasing a releasable connector, wherein the mooring system comprises:

a base structure elevated above of the seabed, a mooring leg having a first end attached to the seabed and a second end attached to the base structure, a column having a first end attached to the base structure and a second end attached to a dual axis joint, a turntable comprising a rotating part rotatively coupled to a fixed part, wherein the rotating part of the turntable is connected to the vessel, wherein the releasable connector comprises a first component connected to the dual axis joint and a second component connected the fixed part of the turntable such that the vessel is rotatable with respect to the column when the first and second components of the releasable connector are connected to one another, a lifting device disposed on the vessel, and a lifting line having a first end connected to the first component of the releasable connector and a second end connected to the lifting device, lowering the column, the base structure, and a portion of the mooring leg toward the seabed with the lifting line and the lifting device such that the base structure is supported by the seabed;

disconnecting the second end of the lifting line from the lifting device; and maneuvering the vessel away from the mooring system.

* * * * *